US010368645B2

(12) United States Patent
Takagi et al.

(10) Patent No.: US 10,368,645 B2
(45) Date of Patent: Aug. 6, 2019

(54) CHAIR AND BACKREST FOR CHAIR

(71) Applicant: OKAMURA CORPORATION, Yokohama-shi, Kanagawa (JP)

(72) Inventors: Yuuichirou Takagi, Yokohama (JP); Alexander Hurford, Yokohama (JP)

(73) Assignee: OKAMURA CORPORATION, Kanagawa (JP)

( * ) Notice: Subject to any disclaimer, the term of this patent is extended or adjusted under 35 U.S.C. 154(b) by 115 days.

(21) Appl. No.: 15/315,178

(22) PCT Filed: Jun. 3, 2015

(86) PCT No.: PCT/JP2015/066017
§ 371 (c)(1),
(2) Date: Nov. 30, 2016

(87) PCT Pub. No.: WO2015/186731
PCT Pub. Date: Dec. 10, 2015

(65) Prior Publication Data

US 2017/0196360 A1 Jul. 13, 2017

(30) Foreign Application Priority Data

Jun. 5, 2014 (JP) ..... 2014-116826
Oct. 15, 2014 (JP) ..... 2014-210862

(51) Int. Cl.
*A47C 7/40* (2006.01)
*A47C 7/42* (2006.01)
*A47C 7/00* (2006.01)

(52) U.S. Cl.
CPC ..... *A47C 7/40* (2013.01); *A47C 7/00* (2013.01); *A47C 7/42* (2013.01)

(58) Field of Classification Search
CPC ..... A47C 7/40; A47C 7/42; A47C 13/005; A47C 3/04; A47C 3/12
See application file for complete search history.

(56) References Cited

U.S. PATENT DOCUMENTS

2005/0151400 A1* 7/2005 Liu ..... A47C 7/40 297/230.13
2007/0257524 A1* 11/2007 Huang ..... A47C 3/04 297/16.1

(Continued)

FOREIGN PATENT DOCUMENTS

CA 2375101 A1 * 12/2000 ..... A47C 1/03277
CH 467605 A * 1/1969 ..... A47C 3/12

(Continued)

OTHER PUBLICATIONS

International Search Report for International Application No. PCT/JP2015/066017, dated Aug. 11, 2015, 4 pages total.

(Continued)

*Primary Examiner* — Timothy J Brindley
(74) *Attorney, Agent, or Firm* — Nixon Peabody LLP; Jeffrey L. Costellia

(57) ABSTRACT

In a chair (1) and a backrest (30) for the chair of the invention, thin back plate extension parts (51) that are continuous with a front surface of a back plate part (31), thinned sections being formed in outside portions, in a width direction of the backrest, on the rear surface side; and reinforcing ribs (52) that protrude from inside end parts of the back plate extension parts (51) in the width direction of the backrest to a rear side are provided in regions of side edge support parts (32) above parts where fitting holes (33) are formed. The reinforcing ribs (52) extend substantially in an upward-downward direction, gradually increase in cross-sectional area on a bottom end side, are connected to the parts where the fitting holes (33) are formed. Additionally, a chair (1*a*, 101, 201) and a backrest (30) for the chair of the invention are provided with a plate-shaped back plate part (31) that receives a seated person's load, and a pair of side edge support parts (32) that are formed integrally with a pair of facing opposite sides of the back plate part (31) and (Continued)

function as strengthening members. A plurality of openings (34) for facilitating deformation of the back plate part (31) are formed in the back plate part (31). A curved part (35) that is curved toward an opposite back plate side extends from one end side of the back plate part (31). The openings (34) of the back plate part (31) formed in the vicinity of the curved part (35) are formed in the shape of an elongated hole in the extending direction of the side edge support parts (32), and are formed at least in a range covering the curved part (35).

14 Claims, 16 Drawing Sheets

(56) References Cited

U.S. PATENT DOCUMENTS

| | | | | |
|---|---|---|---|---|
| 2009/0261644 | A1* | 10/2009 | Piretti | A47C 7/282 297/344.12 |
| 2012/0313411 | A1* | 12/2012 | Fletcher | A47C 3/04 297/239 |
| 2014/0125093 | A1* | 5/2014 | Kassanoff | A47C 3/04 297/183.1 |
| 2016/0255960 | A1* | 9/2016 | Piretti | A47C 5/06 |

FOREIGN PATENT DOCUMENTS

| | | | | | |
|---|---|---|---|---|---|
| CN | 1618374 | | | 5/2005 | |
| CN | 1822780 | | | 8/2006 | |
| CN | 101233978 | | | 8/2008 | |
| EP | 2 215 931 | | | 8/2010 | |
| JP | 08-070955 | A | | 3/1996 | |
| JP | 3895084 | B2 | | 3/2007 | |
| JP | 2007-125223 | A | | 5/2007 | |
| JP | 4295265 | B2 | | 7/2009 | |
| JP | 4295266 | B2 | | 7/2009 | |
| JP | 4491124 | B2 | | 6/2010 | |
| JP | 2011-125615 | A | | 6/2011 | |
| JP | 2012-040062 | | | 3/2012 | |
| JP | 5276304 | B2 | | 8/2013 | |
| JP | 2014-090988 | A | | 5/2014 | |
| JP | 2015027468 | A | * | 2/2015 | A47C 3/12 |
| WO | WO-2011130201 | A1 | * | 10/2011 | A47C 4/02 |

OTHER PUBLICATIONS

Japanese Office Action dated Feb. 6, 2018 issued in JP Pat. App. No. 2014-116826.

European Search Report dated Mar. 5, 2018 issued in EP Pat App. No. 15802822.5.

Chinese Office Action issued in Chinese Applicaiton No. 201580029207.4 dated Dec. 11, 2018, with English translation.

* cited by examiner

CHAIR AND BACKREST FOR CHAIR

TECHNICAL FIELD

The present invention relates to a chair and a backrest for a chair.

Priority is claimed on Japanese Patent Application No. 2014-116826, filed Jun. 5, 2014, and Japanese Patent Application No. 2014-210862, filed Oct. 15, 2014, the contents of which are incorporated herein by reference.

BACKGROUND ART

In chairs used for office work or the like, a seat that supports a seated person's buttock, and a backrest that supports a seated person's back are attached to upper parts of leg posts. A flexible sensation of contact, holding performance for the seated person's back, and the like are required for the backrest. Backrests of chairs that respond to such requirements have been contrived for a long time (for example, refer to Patent Documents 1 to 5).

In a backrest for a chair described in Patent Document 1, side edge support parts of which the forward-backward thickness is greater than that of a back plate part are integrally formed on both left and right sides of a substantially rectangular back plate part, and a fitting hole into which a backrest post is fitted provided at a lower edge of each of the side edge support parts. Left and right edges of the backrest are combined with the left and right backrest posts in the portions of the fitting hole portion. In the case of this backrest for a chair, the side edge support parts with large forward and backward thickness are continuously in the upward-downward direction on both the left and right sides of the back plate part. Hence, if the load of a seated person's upper body is input, rigidity can be maintained by the left and right side edge support part while flexibly deforming the back plate part, and the user's upper body may be held so as to be wrapped therein.

Additionally, in backrests for chairs described in Patent Documents 2 and 3, an outer peripheral region of a substantially rectangular back plate part is surrounded by a frame part with higher rigidity than the back plate part, and, left and right lateral side portions of the frame part are coupled to backrest posts. In the case of these backrests for chairs, the rigidity of peripheral region part can be maintained by the frame part while flexibly deforming the back plate part.

Additionally, in a backrest for a chair described in Patent Document 4, a back plate made of synthetic resin is attached to a backrest frame, and the back plate are provided with a plurality of net-shaped openings. In the case of this backrest, a flexible sensation of contact and holding performance are obtained by guaranteeing support rigidity by the backrest frame and allowing the back plate supported by the backrest frame to be easily elastically deformed by the net-shaped openings.

However, since the backrest for a chair described in Patent Document 4 is made to have a structure including the backrest frame and the backrest frame having the back plate that is a separate component, the number of components is large, and assembly work is apt to become complicated.

Meanwhile, in the backrests for a chair described in Patent Documents 2 and 5, the problem that the number of components increase is solved by integrally providing the frame part with high strength and the back plate part allowing flexible bending deformation in a load support plate made of synthetic resin.

Specifically, in the backrests described in Patent Documents 2 and 5, a thick frame part of which the inside is reinforced by ribs or the like is formed at left and right side edge parts, an upper side part, and a lower side part of the substantially rectangular load support plate made of synthetic resin. Additionally, a thin back plate part is formed in an inside region of the frame part, and a plurality of elongated hole-shaped openings that are long in the upward-downward direction are formed in a substantially entire region of the back plate part. In the case of this backrest, support rigidity is guaranteed by the thick frame part, and a flexible sensation of contact and holding performance are obtained by the thin back plate part having the plurality of openings.

CITATION LIST

Patent Document

[Patent Document 1] Japanese Patent No. 4491124
[Patent Document 2] Japanese Patent No. 4295265
[Patent Document 3] Japanese Unexamined Patent Application, First Publication No. 2014-090988
[Patent Document 4] Japanese Patent No. 3895084
[Patent Document 5] Japanese Patent No. 5276304

SUMMARY OF INVENTION

Technical Problem

Meanwhile, in all of the backrests described in Patent Documents 1 to 3, when a seated person sits down in a regular posture and leans straight to the rear side, a seated person's upper body can be held so as to be wrapped therein without giving the seated person a discomfort.

However, in the case of the backrests described in Patent Documents 1 to 3, when the seated person bends or twists his/her upper body laterally and leans on a backrest, there is a concern that the seated person's upper body hits the side edge support parts and the frame part with high rigidity, and the seated person is given discomfort, such as a sensation of pressure.

Thus, in the invention, when a seated person's upper body leans at a substantially central position in a width direction of a backrest, the seated person's upper body can be held so as to be wrapped therein. Moreover, another object of the invention is to provide a chair and a backrest for a chair in which, when a seated person's upper body leans so as to be biased leftward and rightward, a side edge support part can be flexibly deformed and discomfort to be given to the seated person can be eliminated.

Additionally, in the backrests for a chair described in Patent Documents 2 and 5, a flexible sensation of contact, and the holding performance of a seated person's back can be guaranteed if a central region of a backrest in the width direction can be flexibly deformed to a rear side. However, in the backrests described in Patent Documents 2 and 5, in practice, the thick frame part is continuously formed with an upper side part and a lower side part of the back plate part. Hence, flexible deformation of the back plate part is apt to be hindered by the frame part at upper and lower end parts of the back plate part, particularly, at an upper end part that receives a large load from the seated person's back. For this reason, in the backrests described in Patent Documents 2 and 3, further enhancements to the flexible sensation of contact and the holding performance are desirable.

Thus, an object of the invention is to provide a chair and a backrest for a chair that can obtain high support rigidity, and more flexible deformation in a back plate part, without causing an increase in the number of components.

Solution to Problem

In order to solve the above problems, a backrest for a chair related to a first aspect of the invention is a backrest for a chair including a substantially rectangular back plate part; and a pair of side edge support parts that are formed integrally with the back plate part on both left and right sides thereof and have a maximum forward-backward thickness greater than that of the back plate part. A fitting hole into which a backrest post is fitted from below is formed at a lower edge of each of the side edge support parts. A thin back plate extending part that has a thinned section formed in an outside portion, in a width direction of the backrest, on a rear surface side and is continuous with a front surface of the back plate part, and a reinforcing rib that protrudes from an inside end part of the back plate extending part in the width direction of the backrest to a rear side are provided in a region of the side edge support part above a formation part of the fitting hole. The reinforcing rib extends substantially in an upward-downward direction, gradually increases in cross-sectional area on a bottom end side, and is connected to the formation part of the fitting hole.

Accordingly, when a seated person's upper body leans at a substantially central position of the backrest, the side part of the back plate part is held with high rigidity by the reinforcing rib of each side edge support part while the central region of the back plate part of the backrest is flexibly deformed. Particularly, the rigidity of a section of the reinforcing rib becomes lower compared to the rigidity of the formation part where the fitting hole below the reinforcing hole. However, since the cross-sectional area of the reinforcing rib gradually increases toward the formation part of the fitting hole of which the rigidity of the section is high, the formation part of the fitting hole can be made to efficiently support a load that acts on the upper side of the reinforcing rib.

Meanwhile, when a seated person's upper body leans so as to be biased leftward and rightward, resistance resulting from the back plate extending part being flexibly deformed and the seated person's upper body abutting against backrest can be weakened. Additionally, although the reinforcing rib is provided to partially protrude from a rear part of the back plate extending part, since the rigidity of the reinforcing rib is lower as compared to the rigidity of the formation part of the fitting hole, a resistance force that a seated person receives becomes smaller.

It is desirable that a front surface of the back plate extending part is curved to the rear side toward an outer side in the width direction of the backrest.

In this case, when a seated person's upper body presses the front surface of the back plate extending part, the back plate extending part becomes apt to be deformed to the rear side, and the sensation of resistance that a seated person receives becomes smaller.

Additionally, an extending length of the back plate extending part from the reinforcing rib may gradually decrease toward an upper end side.

The backrest is spaced apart from the support part formed by the backrest post as it becomes closer to the upper end side, and becomes apt to be deformed due to an external force. However, in the case of this structure, the extending length of the back plate extending part gradually decreases toward the upper end side. Therefore, the deformation amount of the back plate extending part itself to the rear side of the side part becomes smaller toward the upper end side. Hence, easy bending of the side edge support part in the upward-downward direction can be balanced, and it is possible to avoid that in which a portion of the side edge support part is bendingly deformed.

Moreover, upper edge parts of the back plate part and the side edge support part may include curved parts that are curved or bend toward the rear side.

In this case, the rigidity of an upper end part of the backrest is enhanced by the curved or bending part. Hence, easy bending of the side edge support part in the upward-downward direction can be further balanced.

Additionally, a chair related to a second aspect of the invention includes the backrest for a chair according to any one of the above descriptions, and the backrest posts.

In order to solve the above problems, a backrest for a chair related to a third aspect of the invention includes a plate-shaped back plate part that receives a seated person's load, and a pair of side edge support parts that are formed integrally with a pair of facing opposite sides of the back plate part and function as strengthening members. A plurality of openings for facilitating deformation of the back plate part are formed in the back plate part. A curved part that is curved toward an opposite back plate side that faces a back plate side where a load from a sitting perform is received is provided to extend at least on one end side of the back plate side in an extending direction of the side edge support part. The openings of the back plate part formed in the vicinity of the curved part are formed in the shape of an elongated hole substantially in the extending direction of the side edge support parts, and the elongated hole-shaped openings are formed at least in a range covering the curved part.

Accordingly, high support rigidity is guaranteed by the pair of side edge support parts, and the back plate part between the pair of side edge support parts can be flexibly deformed at a part coming into contact with a seated person by the plurality of openings. Particularly, the curved part is provided at least on the one end side of the back plate part in the extending direction of each side edge support part, and the elongated hole-shaped openings substantially in the extending direction of the side edge support part are provided at least in the range covering the curved part. Therefore, the backrest part is flexibly deformed in the back plate direction without receiving a large restraining force in the vicinity of the curved part. Hence, the entire region of the back plate part becomes apt to be flexibly deformed so as to follow in a region spaced apart from the curved part of the back plate part.

It is desirable that surfaces of the back plate part and the side edge support part on the back plate side are formed by a continuous surface, and a surface of the back plate part on an opposite back plate side forms a level difference on the back plate side with respect to the surface of the side edge support part on the opposite back plate side.

In this case, since the surfaces of the back plate part and the side edge support part on the back plate side are formed by the continuous surface, the back plate part can be efficiently deformed without giving a seated person a discomfort. Additionally, a seated person's load is input from the back plate part to the end part of the side edge support part on the back plate side, as a load in a compression direction. For this reason, unlike a case where the surface of the back plate part on the opposite back plate side is continuously provided so as to be biased in a planar direction on the opposite back plate side of the side edge support part, a tension load does not easily concentrate on a connected portion between the back plate part and the side edge support part, and the back plate part becomes pat to be flexibly deformed in a wider range.

It is preferable that a thickness of the side edge support part in a back plate direction is made to be greater than a thickness of the back plate part in the back plate direction.

In this case, it is possible to support a load input from the back plate part to each side edge support part with higher rigidity using the side edge support part.

An end edge support part that functions as a strengthening member is provided on the other end side of the back plate part in the extending direction of the side edge support part. Additionally, both end parts of the end edge support part in an extending direction thereof may be integrally coupled to a pair of the side edge support parts, and the curved part may be formed on one end side of the back plate part in the extending direction of the side edge support part.

In this case, even in a case where the amount of bending deformation on the curved part side is set to become large, the rigidity on the remaining three sides of the back plate part can be sufficiently secured by the pair of side edge support parts and the end edge support part.

The curved part may be curved such that an end part in an extending direction forms a change angle exceeding 90°, and the elongated hole-shaped openings are formed so as to straddle an endmost position of the curved part in the extending direction of the side edge support part.

In this case, since the elongated hole-shaped openings are formed so as to straddle the endmost position of the curved part, bending deformation of the back plate part is not easily limited even in a portion in the vicinity of the endmost position. Hence, it is possible to obtain more flexible deformation of the back plate part, and also in a case where a load is directly input from a seated person to the surface of the curved part, it is possible to flexibly the curved part.

A tubular structure in which a plate-shaped front surface side supporting wall that faces the back plate side, and a plate-shaped back surface side supporting wall that faces the opposite back plate side are annularly connected together in the extending direction of the side edge support part may be provided at an end edge of the side edge support part where at least the curved part is located, and the front surface side supporting wall may be formed with almost the same thickness as in the back plate part.

In this case, at least an end edge of the back plate part where the curved part is located is supported by the tubular structure having the front surface side supporting wall and the back surface side supporting wall. For this reason, it is possible to obtain high support rigidity in the side edge support part without causing an increase in weight. Additionally, since the front surface side supporting wall is formed with almost the same thickness as the back plate part, deformation becomes is not easily limited in a portion of the back plate part adjacent to the front surface side supporting wall. Moreover, since a hollow part is provided between the front surface side supporting wall and the back surface side supporting wall, the back surface side supporting wall can also be gripped as a handle during movement or the like of the chair.

A connecting part on one end side of the front surface side supporting wall and the back surface side supporting wall may be formed in a curved shape, and the connecting part may be connected so as to be continuous with a side edge of the curved part.

In this case, a side edge part of the curved part is supported by the connecting part on one end side of the front surface side supporting wall and the back surface side supporting wall. Hence, the deformation behavior of the curved part when the curved part receives a load from a seated person can be stabilized.

In a chair related to a fourth aspect of the invention, the backrest for a chair according to any one of the descriptions related to the above third aspect is supported by a supporting structure having a leg part.

Additionally, the backrest may be supported by the supporting structure such that the curved part is curved to the rear side on the upper end side.

Advantageous Effects of Invention

According to the invention, when a seated person's upper body leans at a substantially central position of the backrest, the seated person's upper body can be held so as to be wrapped therein due to flexible deformation of the back plate part and the rigidity of the reinforcing rib. Moreover, when a seated person's upper body leans so as to be biased leftward and rightward, the side edge support part is flexibly deformed by the thin back plate extending part, so that discomfort, such as a sensation of pressure given to a seated person, can be eliminated.

According to the invention, the curved part is provided at least on the one end side of the back plate part in the extending direction of each side edge support part, and the elongated hole-shaped openings substantially in the extending direction of the side edge support part are provided at least in the range covering the curved part. Hence, even though a structure that does not cause an increase in the number of components is provided, the high support rigidity resulting from the side edge support part and the flexible deformation in the vicinity of the curved part can be obtained.

DESCRIPTION OF EMBODIMENTS

Figure 1:
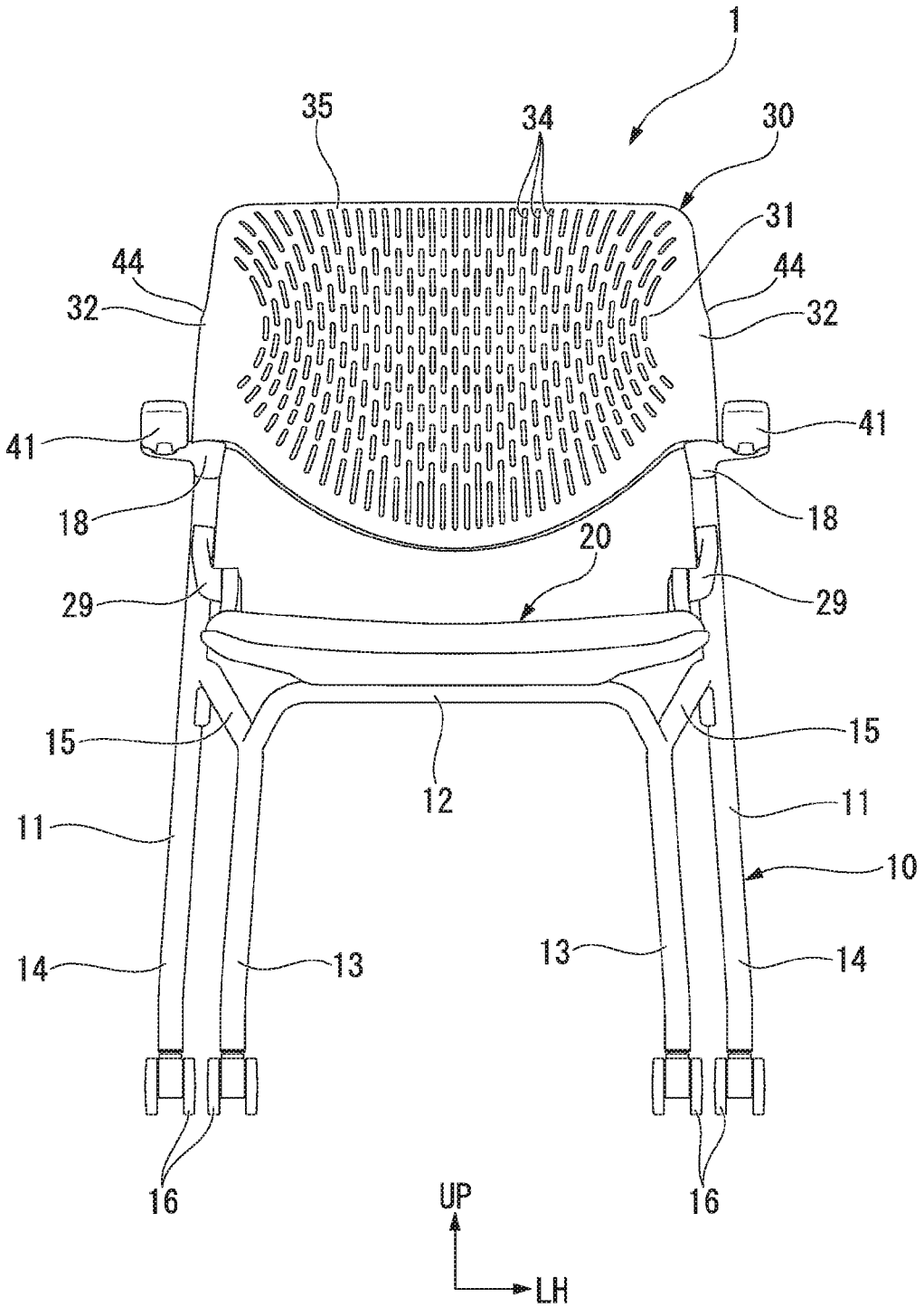
FIG. 1 is a front view of a chair related to a first embodiment of the invention.

Hereinafter, an embodiment of the invention will be described with reference to the drawings. In addition, in the following description, the front of a seated person who sits down on the chair 1 in a regular posture is referred to as "front" and a side opposite to the front is referred to as "rear". Additionally, for "up", "down", "left", and "right", an upside of the seated person who sits down on the chair 1 in the regular posture is referred to as the "up", a side opposite to the upside is referred to as the "down", a left side of the seated person who sits down on the chair in the regular posture is referred to as the "left", and a side to the left side is referred to as the "right". Additionally, arrow FR in the drawings indicates the front, arrow UP indicates the upside, and arrow LH indicates the left side.

First Embodiment

Figure 2:
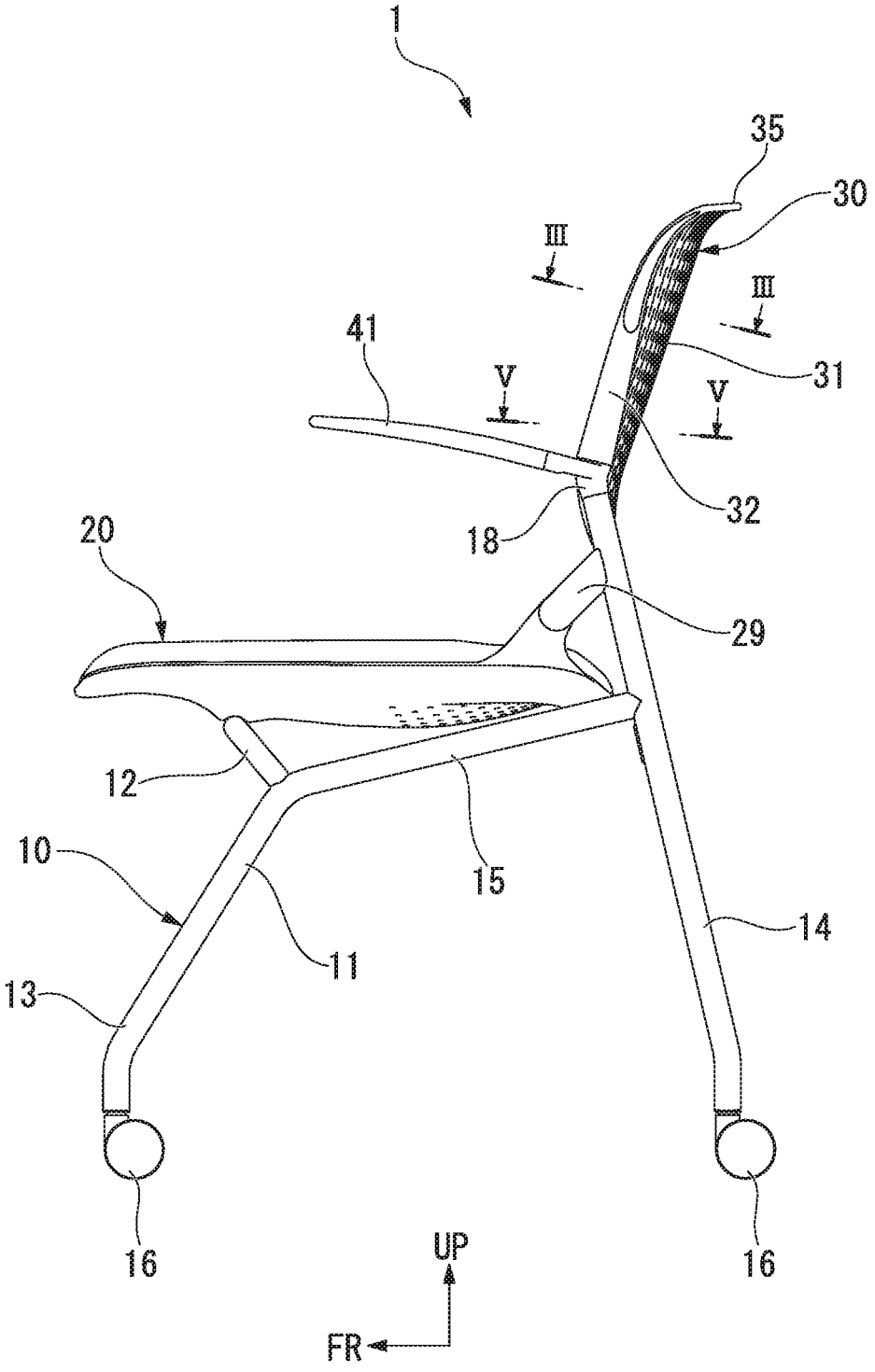
FIG. 2 is a side view of the chair related to the first embodiment of the invention.
Figure 3:
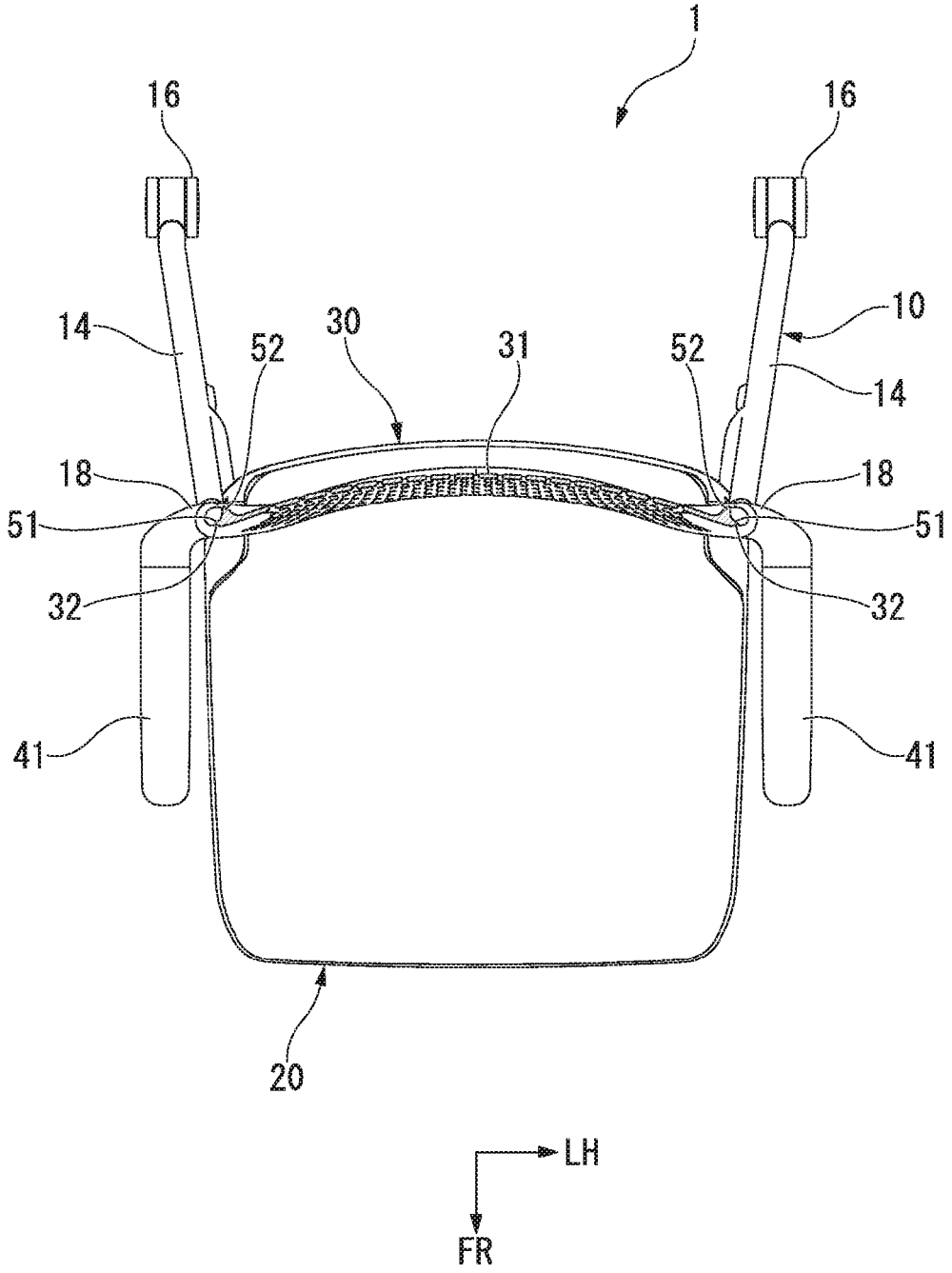
FIG. 3 is a sectional view corresponding to section of FIG. 2 of the chair related to the first embodiment of the invention.

FIG. 1 is a view when the chair 1 related to the first embodiment is seen from the front, and FIG. 2 is a view when the chair 1 is seen from the left side. Additionally, FIG. 3 is a view when the chair 1 is seen from an upper side with a portion of the chair 1 being sectioned.

As shown in these drawings, the chair 1 related to the first embodiment includes a leg part 10 that is placed on a floor surface, a seat 20 that supports a seated person's buttock, and a backrest 30 that is disposed on the rear side of the seat 20 and supports a seated person's back.

The leg part 10 integrally includes a pair of left and right leg frames 11 and 11, and a front frame 12 that couples the left and right leg frames 11 and 11 together. The leg frames 11 and 11 and the front frame 12 are formed of metallic pipe materials.

Each of the left and right leg frames 11 has a front post part 13 that erects while inclining from a lower end to the rear side, a rear post part 14 that erects while inclining from the lower end to a front side, and a connecting support part 15 that couples an upper end part of the front post part 13 and a halfway part in an extending direction of the rear post part 14 together. Casters 16 for being placed to be rollable on the floor surface are attached to respective lower ends of the front post part 13 and the rear post part 14. The connecting support part 15 gently inclines obliquely upward from a position of connection with the front post part 13 on a front end side toward a position of coupling with the rear post part 14 on a rear end side.

Additionally, an attachment base 18 to which the backrest 30 is attached is formed in a region closer to the upper side than the coupling position of the rear post part 14 with the connecting support part 15.

Additionally, the front frame 12 extends substantially horizontally in a leftward-rightward direction, and both end parts thereof are coupled to upper end parts of the respective front post parts 13 of the left and right leg frames 11 and 11. The left and right leg frames 11 and 11 restrict opening in the leftward-rightward direction on the front side in a state where a seated person's load has acted. Additionally, the front frame 12 receives the load of the seat 20 by abutting against a lower surface of a front edge part of the seat 20. In addition, opening in the leftward-rightward direction on the rear side of the left and right leg frames 11 and 11 is restricted by the backrest 30 by the left and right rear post parts 14 and 14 (attachment bases 18 and 18) being coupled to the backrest 30.

Supporting arm parts 29 that extend to a front lower side and is coupled to a rear edge part of the seat 20 extends between the coupling positions of the left and right rear post parts 14 with the connecting support parts 15, and the attachment bases 18. Hence, the seat 20 is supported by the leg part 10 via the front frame 12 and the supporting arm parts 29. Additionally, backrest posts 40 (refer to FIGS. 4 and 5) that protrude upward and are coupled to left and right lower edges of the backrest 30, and armrests 41 that extend forward substantially horizontally are provided to extend in the left and right attachment bases 18 and 18.

The entire backrest 30 is integrally formed of synthetic resin. The backrest 30 includes a substantially rectangular plate-shaped back plate part 31 that receives a load to a seated person's back, and a pair of side edge support parts 32 that are formed integrally with the left and right side end parts of the back plate part 31. The maximum forward-backward thickness of each side edge support part 32 at each height position in an upward-downward direction is set to be greater than the forward-backward thickness of the back plate part 31.

The back plate part 31 is formed to have a substantially constant thickness in its entirety, and a plurality of openings 34 for facilitating deformation of the back plate part 31 are formed in a substantially entire region excluding substantially intermediate positions in the upward-downward direction in left and right side parts. Almost the entire openings 34 are formed in the shape of an elongated hole that runs substantially in the upward-downward direction. For this reason, if a load is input from a seated person's back to a front surface side of the back plate part 31, a central region of the back plate part 31 in a width direction is bendingly deformed flexibly toward the rear side.

Additionally, the central region of the back plate part 31 in the width direction is formed in a curved shape that becomes gently depressed in a concave shape to the rear side, and a curved part 35 that is curved up to the vicinity of a substantially horizontal posture toward the rear side (opposite back plate side) is provided to extend on an upper end side of the back plate part.

Figure 4:
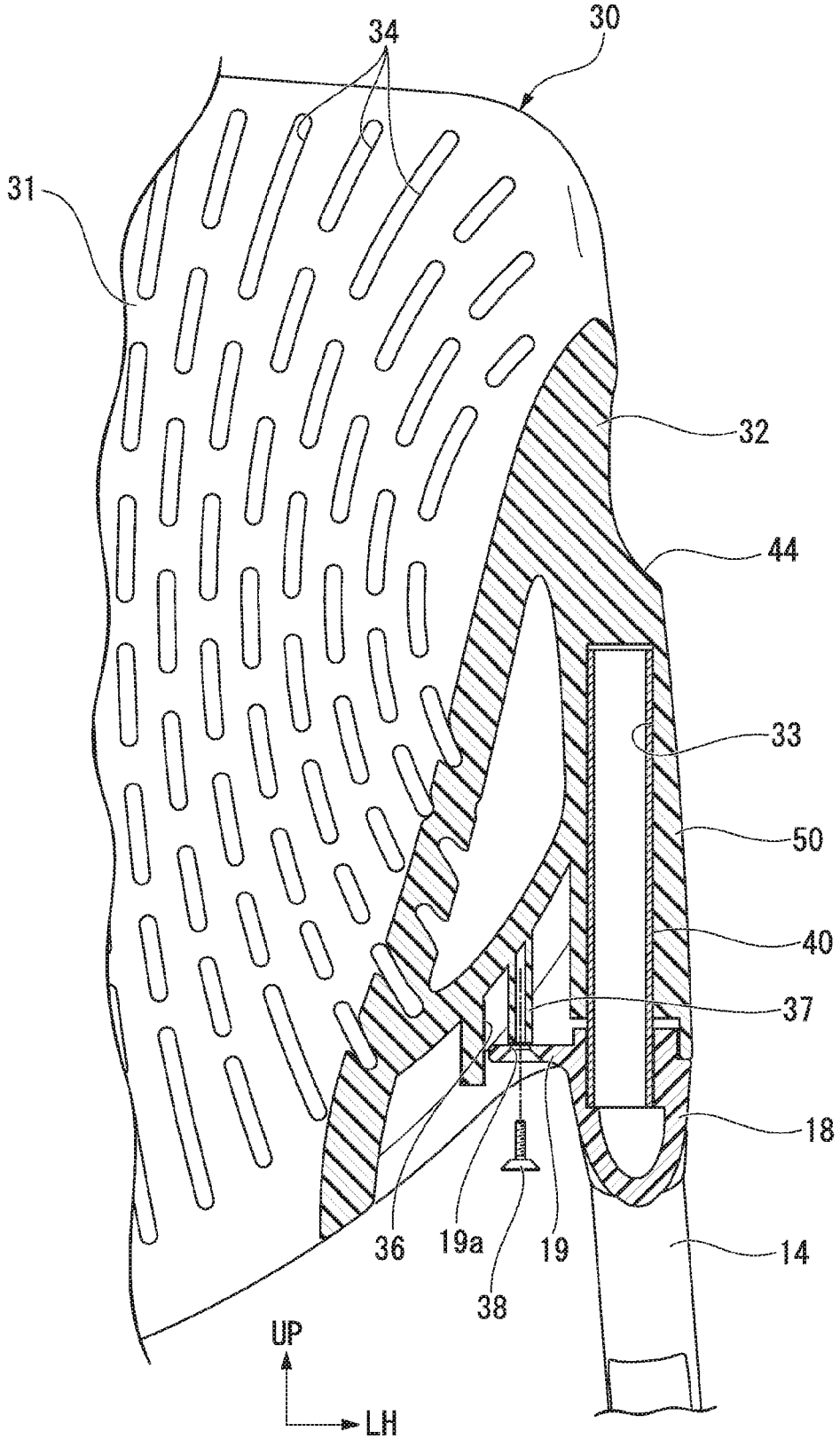
FIG. 4 is a partially sectional front view of a backrest of the chair related to the first embodiment of the invention.
Figure 5:
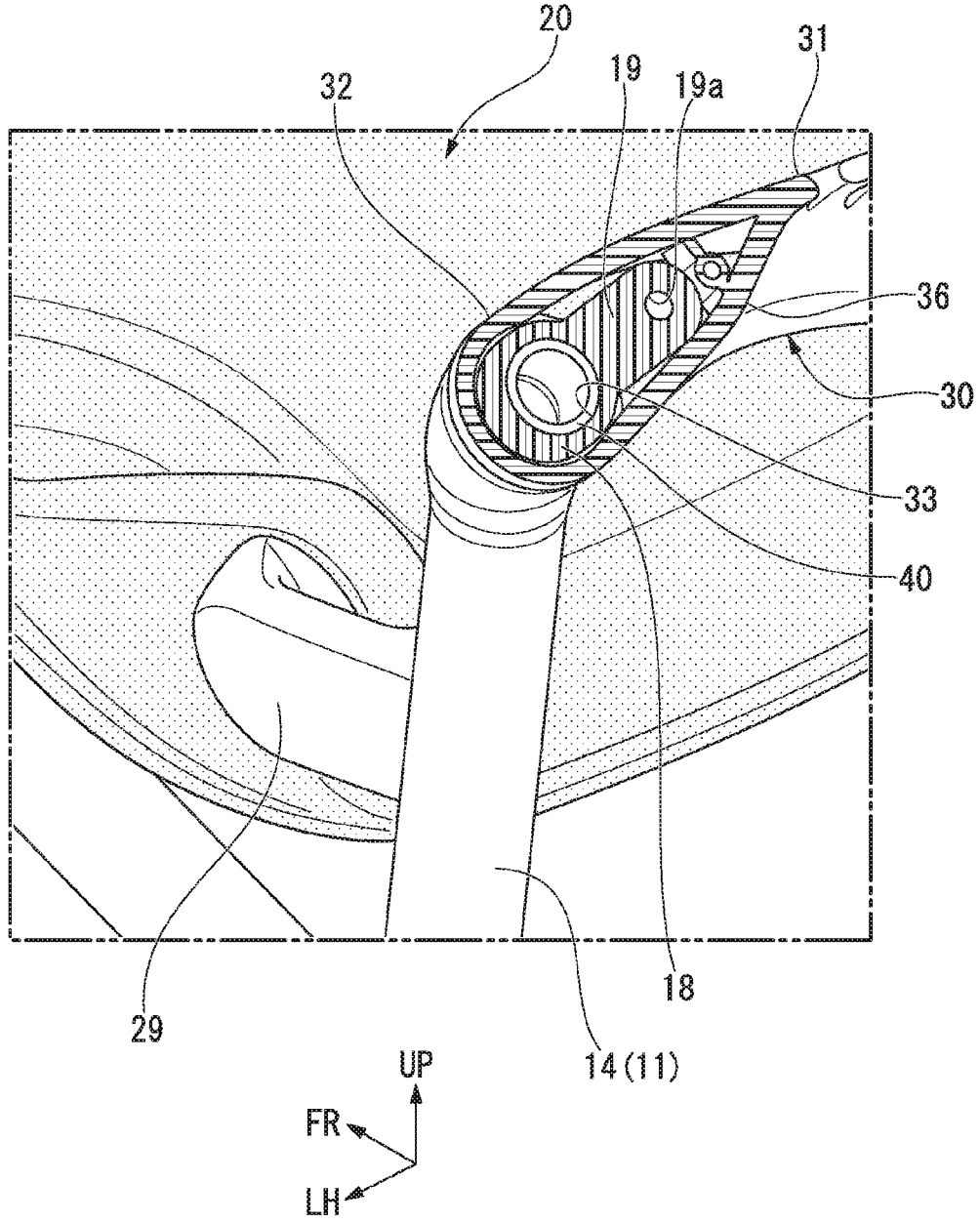
FIG. 5 is a perspective view when portion V-V of FIG. 2 of the chair related to the first embodiment of the invention is sectioned.

FIGS. 4 and 5 are views showing a portion of the backrest 30 in section. Fitting holes 33 into which the backrest posts 40 are fitted are formed at lower edges of the left and right side edge support parts 32 of the backrest 30. A fastening piece 19 that extends from a protruding position of each backrest post 40 toward an inner side in the width direction of the backrest is integrally formed in the attachment base 18 of an upper end of each rear post part 14 of the leg frame 11. A screw hole 19*a* for screw-fastening the backrest 30 to the attachment base 18 is formed in the fastening piece 19.

Meanwhile, an elongated hole-shaped holding hole 36 is formed adjacent to an inner side of each fitting hole 33 in the width direction of the backrest in a lower surface of a side edge part of the backrest 30, and a boss part 37 against which an upper surface of the fastening piece 19 is struck is integrally formed on a bottom side of the holding hole 36. The fastening piece 19 is struck against the boss part 37 in a state where the fastening piece is inserted into the holding hole 36, and is fastened and fixated to the boss part 37 by a screw 38. The backrest 30 is integrally coupled to the leg part 10 by fitting the fitting holes 33 of the left and right side edge support parts 32 to the corresponding left and right backrest posts 40 and by inserting the fastening pieces 19 of the attachment bases 18 into the holding holes 36 to screw-fasten the fastening pieces 19 to the boss parts 37. Each fastening piece 19 inserted into each holding hole 36 functions to suppress deformation of each side edge part of the backrest 30 centered on each backrest post 40 when a large deformation load that faces the rear side has acted on the side edge part on a bottom end side of the backrest 30. Additionally, the fastening piece 19 functions to restrict a lower end part of the backrest 30 from being displaced forward with a substantially central part of the backrest 30 in the upward-downward direction as a fulcrum when a deformation load that faces the rear side has acted on the vicinity of an upper end part of the backrest 30.

Meanwhile, each of the left and right side edge support parts 32 of the backrest 30 is divided into an upper region where the width of the backrest in the width direction is smaller and a lower region where the width of the backrest in the width direction is greater than that of the upper region, with the substantially central part in the upward-downward direction as a border. Each fitting hole 33 to which each backrest post 40 is fitted is formed in the lower region. The lower region of each side edge support part 32 where the fitting hole 33 is formed is continuously provided so as to swell in a substantially cylindrical shape to a side part of the back plate part 31 because the diameter of the backrest post 40 is sufficiently greater than the thickness of the back plate part 31. The lower region of the side edge support part 32 is hereinafter referred to as a post coupling part 50. A continuously-provided part 44 that is curved smoothly from a lower end to the inner side in the width direction of the backrest toward the upside in a front view, as shown in FIG. 4, is provided between an outside edge on an upper end side of the post coupling part 50 and an outside edge on a bottom end side of the upper region of the side edge support part 32.

Figure 6:
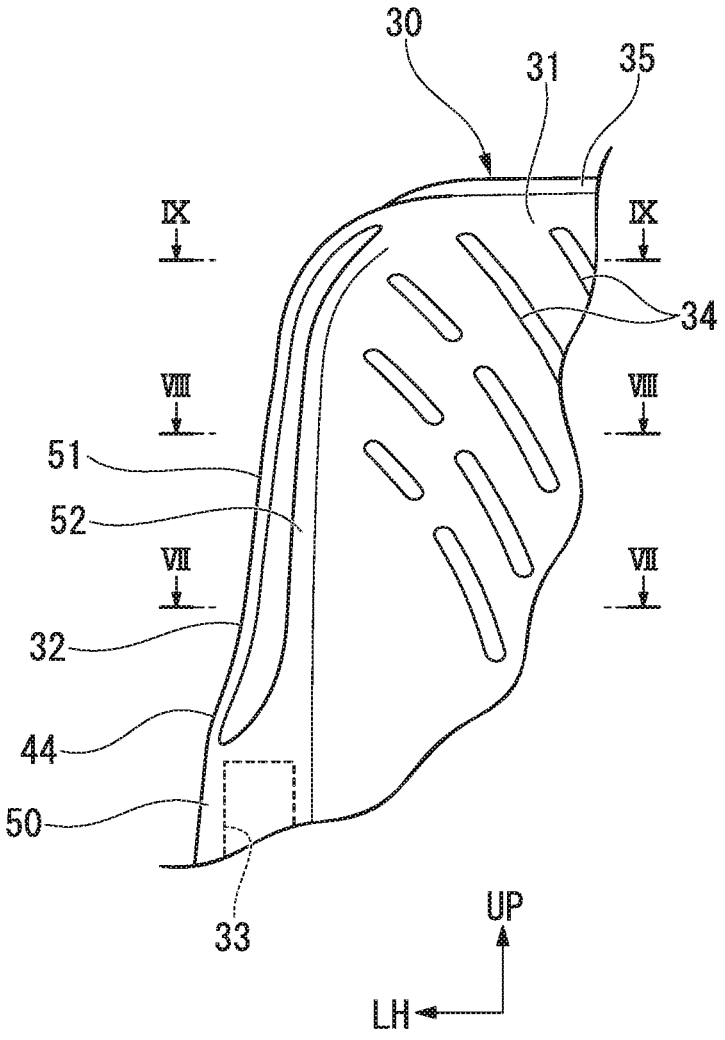
FIG. 6 is a rear view of the backrest of the chair related to the first embodiment of the invention.
Figure 7:
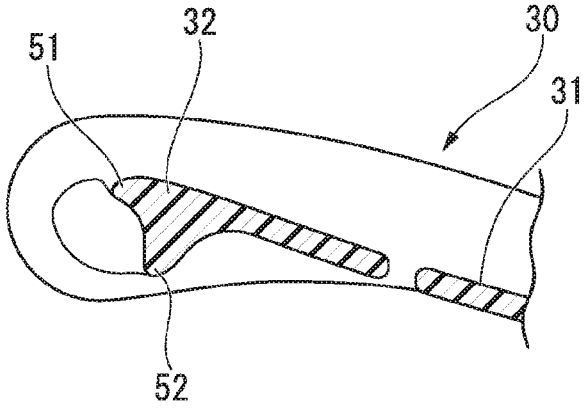
FIG. 7 is a sectional view corresponding to section VII-VII of FIG. 6 of the backrest of the chair related to the first embodiment of the invention.
Figure 8:
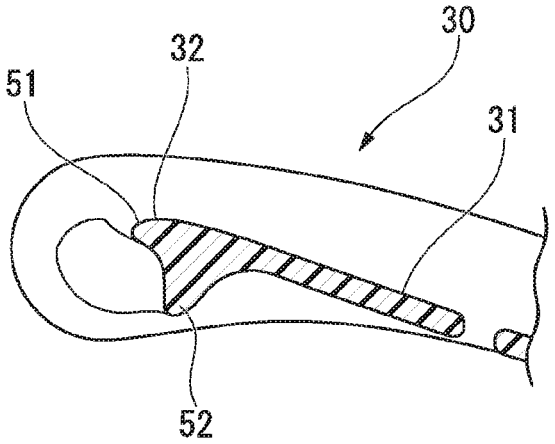
FIG. 8 is a sectional view corresponding to section VIII-VIII of FIG. 6 of the backrest of the chair related to the first embodiment of the invention.
Figure 9:
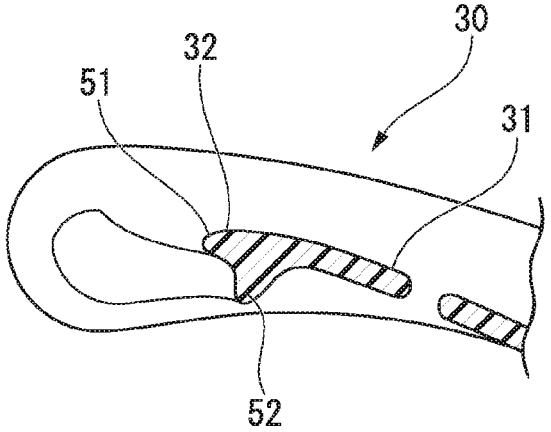
FIG. 9 is a sectional view corresponding to section IX-IX of FIG. 6 of the backrest of the chair related to the first embodiment of the invention.

FIG. 6 is a view when a left side edge of the backrest 30 is seen from a rear surface side, and FIGS. 7 to 9 are views showing sections of the left side edge of the backrest 30. In addition, although the structure of the side edge part of the backrest 30 will be described below with reference to FIGS. 6 to 9, a right side edge of the backrest 30 is also made to have the same structure as the left side edge.

In a region above the post coupling part 50 of the side edge support part 32, a thinned section is formed in an outside portion in the width direction of the backrest on the rear surface side, and a back plate extending part 51 that extends laterally from a side end part of the back plate part 31 with almost the same thickness as the back plate part 31, and a reinforcing rib 52 that protrudes from an inside end part of the back plate extending part 51 in the width direction of the backrest to the rear side are provided.

The back plate extending part 51 and the reinforcing rib 52 are continuously formed substantially in the upward-downward direction of the backrest 30. A front surface of the back plate extending part 51, as shown in FIGS. 7 to 9, is smoothly continuous with the front surface of the back plate part 31, and is curved to the rear side toward an outer side end part of the back plate extending part in the width direction of the backrest. Additionally, the cross-sectional area of the reinforcing rib 52 gradually increases toward a downside and is smoothly continuous with an upper end part of the post coupling part 50 that is a formation part of the fitting hole 33.

Moreover, a rear surface of the back plate extending part 51, and the reinforcing rib 52 are formed in a smoothly curved manner so as to be open to a rear side in the width direction of the backrest, in a sectional view in the width direction of the backrest 30.

Additionally, the extending length of the back plate extending part 51 from the reinforcing rib 52, as shown in FIGS. 7 to 9, gradually decreases toward an upper end side of the backrest 30. The back plate extending part 51 and the reinforcing rib 52 is curved toward the back plate part 31 side at the upper end part of the backrest 30, and are connected to the curved part 35 of an upper end of the back plate part 31.

As described above, in the backrest 30 of the chair 1 related to the first embodiment, the side edge support parts 32 are provided on both the left and right sides of the back plate part 31, and the lower ends of the side edge support parts 32 are supported by the left and right backrest posts 40 via the fitting holes 33. Since each side edge support part 32 is formed such that each reinforcing rib 52 is continuous with an upper part of each post coupling part 50 rigidly supported by each backrest post 40 in the upward-downward direction, a backrest load applied to a substantial center of the back plate part 31 in the width direction of the backrest can be supported with high rigidity.

Specifically, when a seated person's upper body leans at a substantially central position of the backrest 30, the side part of the back plate part 31 is held with high rigidity by the reinforcing rib 52 that is continuous with the post coupling part 50 of the side edge support part 32 and the upside thereof while the central region of the back plate part 31 is flexibly deformed to the rear side. In this case, the rigidity of a section of the reinforcing rib 52 of the side edge support part 32 becomes lower than that of the lower post coupling part 50. However, a structure in which the cross-sectional area gradually increases toward the post coupling part 50 of which the rigidity of a section is high is provided. Therefore, the post coupling part 50 can be made to efficiently support a load that acts on the upper side of the reinforcing rib 52 from the back plate part 31.

Hence, in a case where the backrest 30 related to the first embodiment is adopted, a seated person's upper body can be reliably held so as to be enwrapped due to the flexible deformation of the back plate part 31 and the rigidity of the reinforcing rib 52.

Additionally, in the backrest 30 of the chair 1 related to the first embodiment, the thin back plate extending part 51 is provided on the upper side of the post coupling part 50 of the side edge support part 32, and the reinforcing rib 52 is provided to protrude from a position apart from the end part of the back plate extending part 51 in the width direction of the backrest. For this reason, when a seated person's upper body has touched an end edge of the side edge support part 32 in the width direction of the backrest, the touched portion can be flexibly deformed and a resistance force can be weakened.

Specifically, when a seated person's upper body is biased leftward and rightward of the backrest 30 and leans on the backrest 30, the thin back plate extending part 51 is flexibly deformed to the rear side while the entire reinforcing rib 52 is gently curved to the rear side, and thereby the resistance force resulting from abutment of the seated person's upper body against the reinforcing rib is weakened. Here, when a seated person sits down in the regular posture, the reinforcing rib 52 is set so as to be capable of supporting the backrest load with sufficient rigidity in the entire region in the upward-downward direction. However, part rigidity with a small cross-sectional area becomes smaller as compared to the post coupling part 50 below the side edge support part 32. For this reason, even if a seated person's upper body abuts against a front position of the reinforcing rib 52 of the back plate extending part 51, a sensation of pressing that a seated person receives becomes small.

Hence, in a case where the backrest 30 related to the first embodiment is adopted, discomfort, such as a sensation of pressure given to a seated person, can be eliminated.

Additionally, in the backrest 30 related to the first embodiment, the front surface of the back plate extending part 51 is curved to the rear side toward the outer side in the width direction of the backrest. For this reason, when a seated person's upper body presses the front surface of the back plate extending part 51, the back plate extending part 51 becomes apt to be deformed to the rear side, and the sensation of pressure that a seated person receives becomes smaller.

Moreover, in the backrest 30 related to the first embodiment, the extending length of the back plate extending part 51 from the reinforcing rib 52 gradually decreases toward the upper end side. For this reason, even when a seated person's backrest load concentrates on the vicinity of an upper corner part of the backrest 30, the upper corner part of a backrest 30 can be inhibited from being extremely greatly deformed to the rear side. That is, as the backrest 30 approaches the upper end side, the separation distance from the post coupling part 50 becoming longer. As a result, the amount of deformation when the backrest receives an external force becomes larger. However, in the first embodiment, easy bending of the side edge support part 32 in the upward-downward direction is balanced by gradually decreasing the extending length of the back plate extending part 51 from the reinforcing rib 52 toward the upper end side. Hence, in the case of the backrest 30 related to the first embodiment, it is possible to avoid that a portion of the side edge support part 32 is bendingly deformed greatly.

Moreover, in the case of the first embodiment, the curved part 35 that is curved toward the rear side is provided at an upper end part of the back plate part 31, and an upper end part of the side edge support part 32 and the curved part 35 thereof are continuous with each other. Accordingly, since the rigidity of the upper end part of the side edge support part 32 is further enhanced by the curved part 35, the easy bending of the side edge support part 32 in the upward-downward direction can be further balanced. Instead of providing the curved part 35, a bending part may be provided at the upper end of the back plate part 31.

Additionally, in the backrest 30 related to the first embodiment, the continuously-provided part 44 that is curved smoothly from the lower end to the inner side in the width direction of the backrest toward the upside, is provided between the outside edge on the upper end side of the post coupling part 50 and the outside edge on the bottom end side of the upper region of the side edge support part 32. Moreover, the rear surface of the back plate extending part 51, and the reinforcing rib 52 are formed in a smoothly curved manner so as to be open to the rear side in the width direction of the backrest. For this reason, when a load that faces the rear side is input to an upper part of the backrest 30, stress concentration does not easily occur in respective parts of the side edge support part 32. That is, if a corner part is present in one part of the side edge support parts 32, stress becomes apt to concentrate on the corner part at the time of input of a load. However, in the case of the first embodiment, the respective parts of the side edge support part 32 are formed in the shape that is smoothly curved as described above. Therefore, stress concentration can be avoided. Hence, in the case of the first embodiment, when a load that faces the rear side is input to the upper part of the backrest 30, the entire region of the side edge support part 32 can be bendingly deformed in a well-balanced manner.

Additionally, in the case of the backrest 30 that related to the first embodiment, a region where the plurality of openings 34 are not formed are provided at a substantially intermediate position (the vicinity of the continuously-provided part 44 on the upper end side of the post coupling part 50) in the upward-downward direction in each of the left and right side parts of the back plate part 31. For this reason, when the upper region of the backrest 30 of the side edge support part 32 is displaced to the rear side with a boundary part (the vicinity of the continuously-provided part 44) between the upper region and the a lower region as a fulcrum, it is possible to prevent a situation in which excessive stress acts on end parts of the openings 34 and the back plate part 31 deteriorates.

Second Embodiment

Next, a chair 1*a* related to a second embodiment related to the invention will be described with reference to FIGS. 10 to 14.

In addition, in description of respective embodiments to be described below, the same parts as those of the above first embodiment will be designated by the same reference signs, and a duplicate description thereof will be omitted here.

Figure 10:
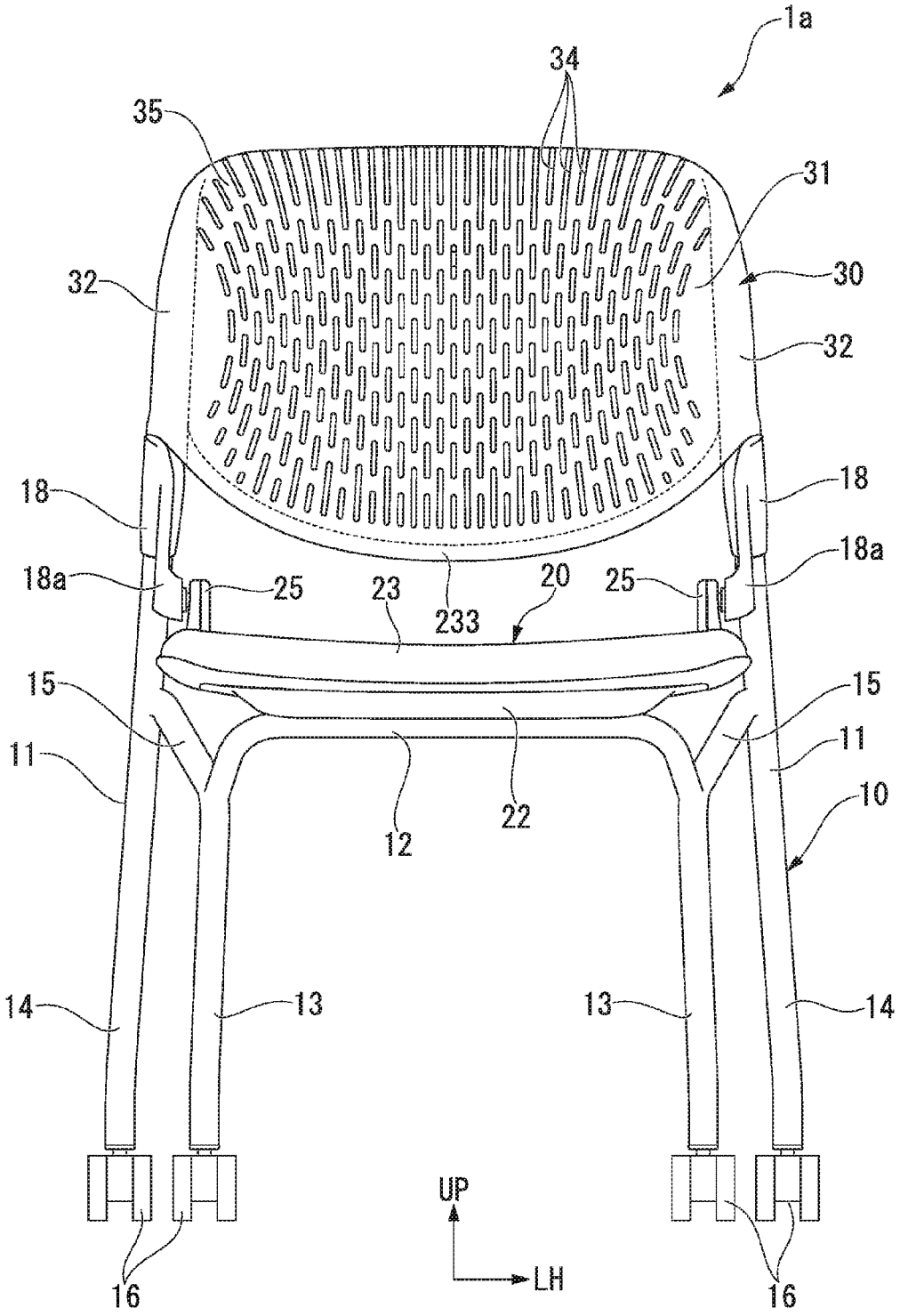
FIG. 10 is a front view of a chair related to a second embodiment of the invention.
Figure 11:
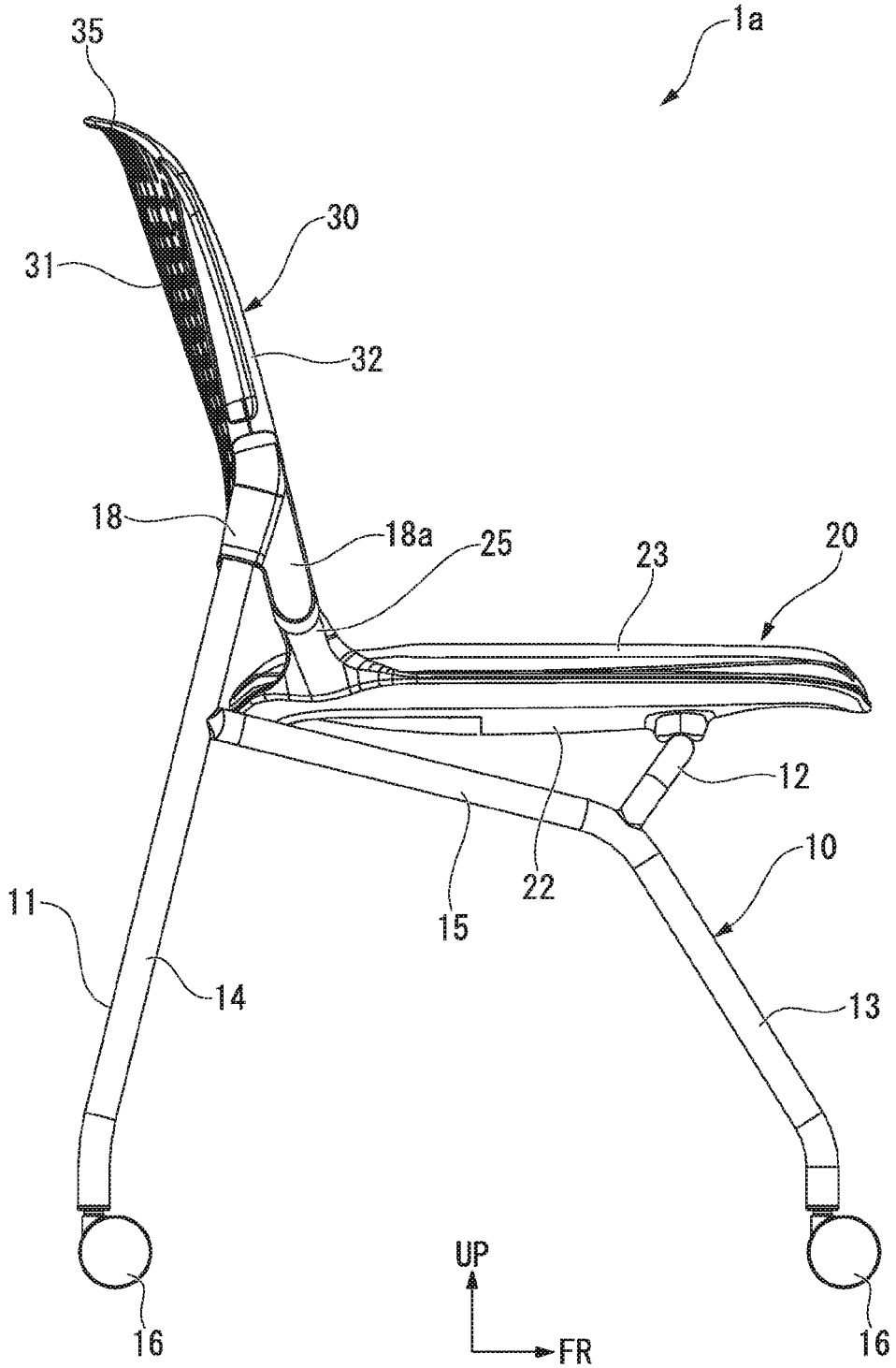
FIG. 11 is a side view of the chair related to the second embodiment of the invention.
Figure 12:
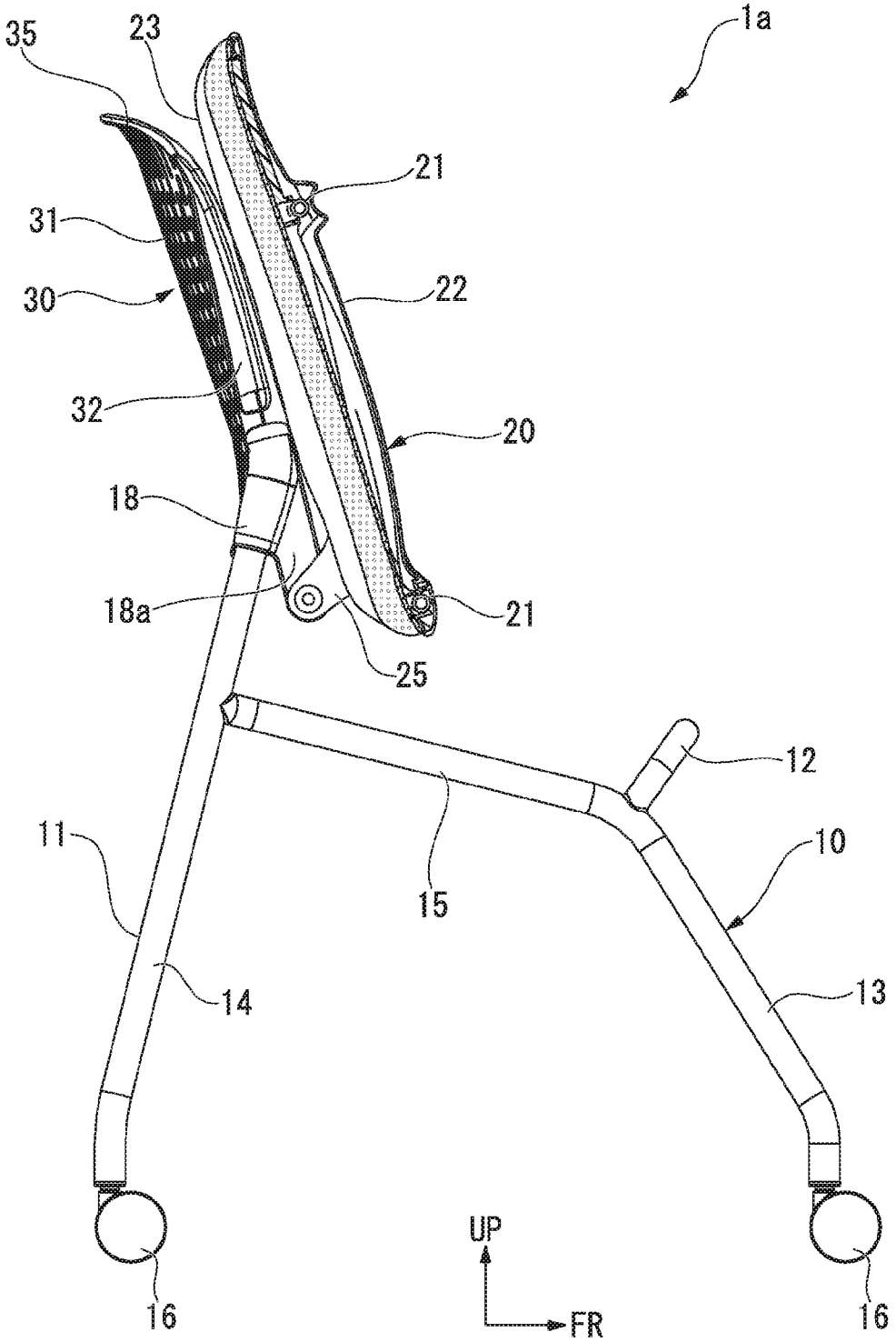
FIG. 12 is a partial sectional side view in a state where a seat of the chair related to the second embodiment of the invention is flipped up.
Figure 13:
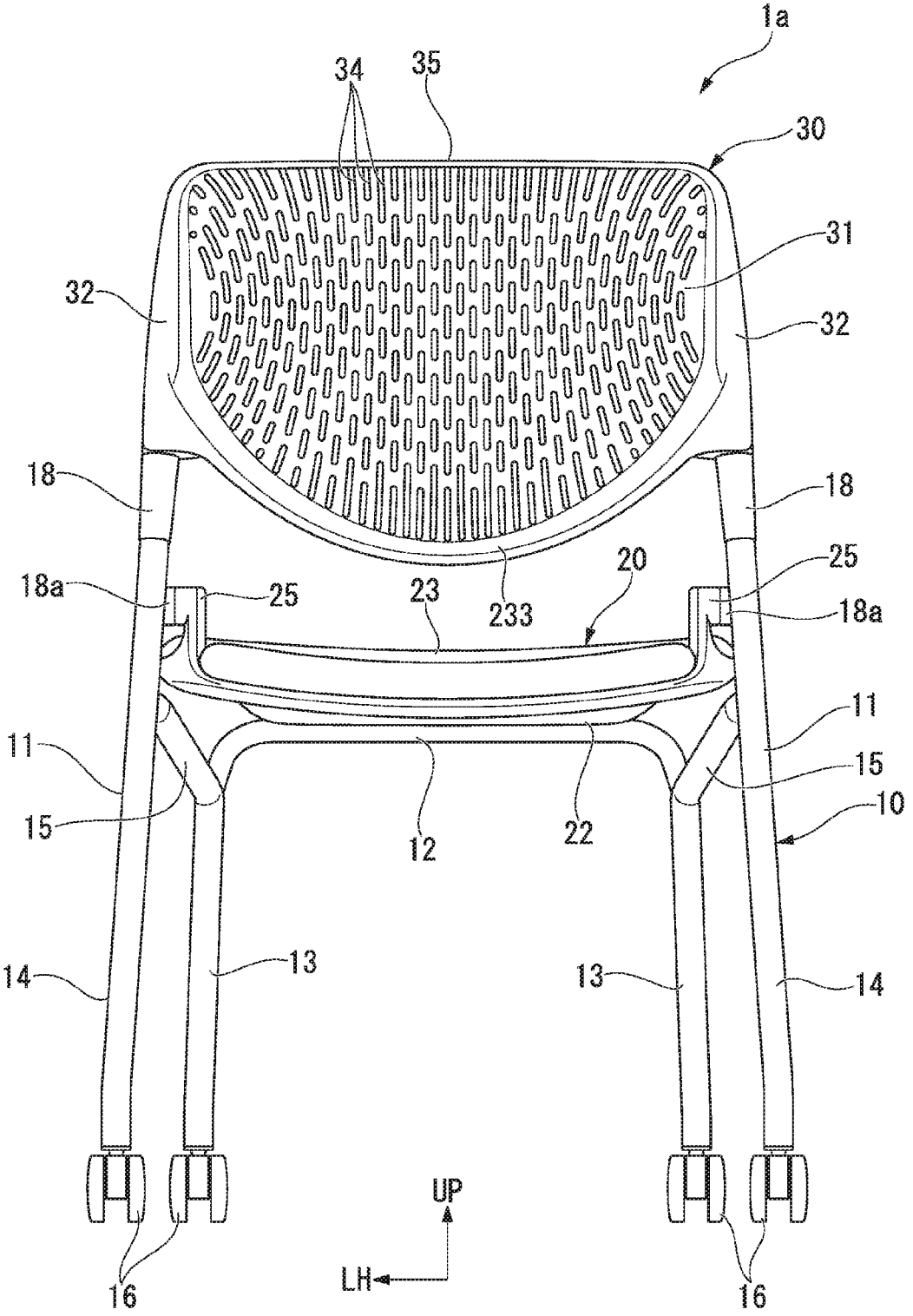
FIG. 13 is a back view of the chair related to the second embodiment of the invention.
Figure 14:
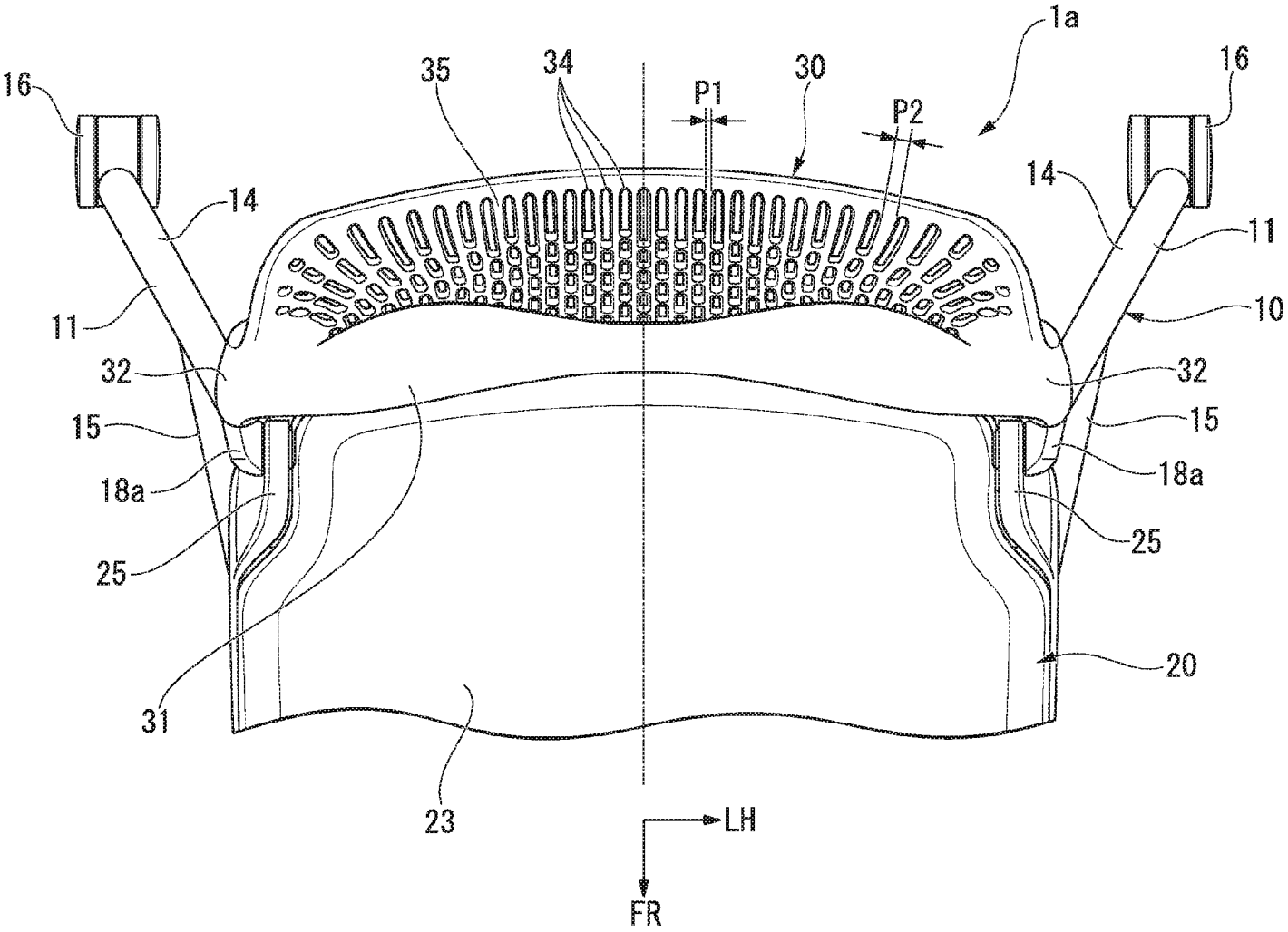
FIG. 14 is a top view of the chair related to the second embodiment of the invention.

FIG. 10 is a front view of the chair 1*a* related to the second embodiment, and FIG. 11 is a right side view of the chair 1*a*. Additionally, FIG. 12 is a partial sectional side view of the chair 1*a* in a state where the seat 20 is flipped up, FIG. 13 is a back view of the chair 1*a*, and FIG. 14 is a top view of the chair 1*a*.

The seat 20 is turnably flipped up to the upper side with the rear side as a fulcrum, as will be described below in detail.

Additionally, the front frame 12 receives the load of the seat 20 by abutting against a lower surface of the front edge part of the seat 20 when the seat 20 is operated to turn up to a substantially horizontal posture.

Additionally, the left and right attachment bases 18 and 18 of the leg part 10 are provided with connecting support parts (not shown) that protrude upward and are coupled leftward and rightward end parts of the backrest 30, and supporting arm parts 18*a* that extends to the front lower side and are turnably coupled to the rear edge part of the seat 20.

As shown in FIG. 12, the seat 20 has a seat frame 21 made of metallic pipe materials, a lower cover 22 that covers a lower surface of the seat frame 21, and a seat face member 23 that covers the upside of the seat frame 21. Coupling arms 25 that are formed in a substantially rectangular shape in a top view and are turnably coupled to the respective supporting arm parts 18*a* of the left and right attachment bases 18 at both the left and right edges on the rear end side are provided to extend in the seat 20. The seat 20 is made to be appropriately switchable between a flipped-up posture shown in FIG. 12 in which the seat are flipped up with the left and right supporting arm parts 18*a* as fulcrums and a forwardly laid posture shown in FIG. 11 in which the seat is laid substantially horizontally to the front side with the left and right supporting arm parts 18*a* as fulcrums.

In the second embodiment, the backrest 30 constitutes a load support of the chair. Additionally, the aforementioned leg part 10 and seat 20 constitute a supporting structure in the second embodiment.

The backrest 30 includes the substantially rectangular plate-shaped back plate part 31 that receives a load to a seated person's back, the pair of side edge support parts 32 that are formed integrally with left and right opposite sides of the back plate part 31 and function as strengthening members, and an end edge support part 233 that are formed integrally with a lower side of the back plate part 31 and function as a strengthening member, similar to the side edge support parts 32. Each side edge support part 32 in the second embodiment extends substantially in the upward-downward direction in a state where the side edge support part is attached to the leg part 10, while inclining slightly toward a rear upper side.

Although the back plate part 31 is formed in a substantially rectangular shape in a front view, exactly, left and right side edges are formed in straight lines that are parallel to each other, an upper side is formed in a straight line with a gentle circular arc, and a lower side is formed in a substantially circular-arc shape that swells convexly to the lower side.

The back plate part 31 is formed to have a substantially constant thickness in its entirety, and the plurality of openings 34 for facilitating deformation of the back plate part 31 are formed in a substantially entire region of the back plate part. In the case of this embodiment, almost the entire openings 34 are formed in the shape of an elongated hole that runs substantially in the upward-downward direction (along the extending direction of the side edge support part 32). In the back plate part 31, almost the entirety of each of the openings 34 become elongated hole-shaped openings that run substantially in the upward-downward direction. Therefore, if a load is input to the front surface side (load-receiving side) of the back plate part 31, the central region of the back plate part in the width direction becomes apt to bend in a concave shape.

In addition, as for the plurality of openings 34 of the second embodiment, a plurality of rows of the openings that extend in straight lines in the upward-downward direction or extend in substantially straight lines that are slightly curved and that are aligned in the upward-downward direction are provided side by side in the width direction. The openings 34 of rows adjacent to each other in the width direction are disposed so as to be offset in a houndstooth shape in the upward-downward direction. In the case of the second embodiment, since the openings 34 of the back plate part 31 are formed in the shape of an elongated hole that is long substantially in the upward-downward direction, a movement in which the openings try to widen easily in the width direction due to an input load from the front surface side is not hindered, and since the openings 34 are disposed in a houndstooth shape as described above, a movement in which the openings 34 adjacent to each other try to widen in the width direction is not hindered. Therefore, more flexible deformation of the back plate part 31 can be easily obtained.

Additionally, the central region of the back plate part 31 in the width direction is formed in a curved shape that becomes gently depressed in a concave shape to the rear side, and the curved part 35 that is curved up to the vicinity of a substantially horizontal posture toward the rear side (opposite back plate side) is provided to extend on the upper end side (one end side in the extending direction of the side edge support part 32) of the back plate part. The aforementioned openings 34 are formed at least in a range covering the curved part 35. In the case of the second embodiment, the openings 34 provided in the curved part 35 has a longer extending length in the upward-downward direction, as compared to the openings 34 formed in the central region of the back plate part 31 in the upward-downward direction, and are formed so as to reach the vicinity of a terminal of the curved part 35.

Additionally, in the case of the second embodiment, the adjacent pitch between the openings 34 of the curved part 35 in the width direction, as shown in FIG. 14, is set such that an adjacent pitch P1 in the central region in the width direction is set to be narrower than an adjacent pitch P2 in end part regions on both sides.

Hence, in the case of the second embodiment, the adjacent pitch P1 between the openings 34 in the central region of the curved part 35 in the width direction is narrow. Therefore, the proportion that the openings 34 occupy in a constant area in the central region of the curved part 35 in the width direction becomes large. For this reason, the deformation amount in the central region of the curved part 35 in the width direction can be further increased as compared to the deformation amount in the end part regions on both sides. As a result, it is possible to further enhance a sensation of seating and holding performance of the backrest 30.

The side edge support parts 32 on both the left and right sides of the back plate part 31 are formed in a substantially tapered columnar shape that is gently tapered from lower end parts fitted to the connecting support parts (not shown) of the attachment bases 18 toward the upper side. The thickness (diameter) of each side edge support part 32 in the forward-backward direction is set to be sufficiently greater than the thickness of the back plate part 31 as a whole. Additionally, an upper edge part of the side edge support part 32 is gently curved toward the upper end side and toward the rear side, and the curved region is connected to a side edge of the curved part 35 of the back plate part 31 while the thickness thereof is brought gradually closer to that of this side edge.

Additionally, the end edge support part 233 on the lower side of the back plate part 31 has a right-angled part formed in a substantially a right-angled triangular sectional shape that is located at a lower end on the front surface side and has end parts on both sides coupled to bottom end side surfaces of the left and right side edge support parts 32. The thickness of the end edge support part 233 in the forward-backward direction is set to be greater than the thickness of the back plate part 31, similar to the side edge support part 32.

Here, front surfaces (surfaces on the back plate side) of the back plate part 31, the left and right side edge support parts 32, and the end edge support part 233 on the lower side are formed by a smoothly continuous surface that does not substantially have a level difference. However, a rear surface (a surface on the opposite back plate side) of the back plate part 31 forms a bump on the front side (back plate side) with respect to the rear surface (a surface on the opposite back plate side) of each side edge support part 32 or the end edge support part 233.

The chair 1*a* related to the second embodiment is used in a state where the seat 20 is laid substantially horizontally to the front side with the left and right supporting arm parts 18*a* as fulcrums, and the front frame 12 is made to support a lower surface of a front part of the seat 20. If a seated person sits on the seat 20 in this state and leans his/her back on the backrest 30, when the back plate part 31 of the backrest 30 receives a seated person's load on the front surface side and the plurality of vertically-long openings 34 of the back plate part 31 are pushed open in the leftward-rightward direction, the central region of the back plate part 31 in the width direction is bendingly deformed in a concave shape to the rear side.

In this case, the left and right side edges of the back plate part 31 of the backrest 30 are supported by the left and right attachment bases 18 and 18 of the leg part 10 via the side edge support parts 32 with high rigidity, and the lower side thereof is supported by the left and right attachment bases 18 and 18 via the lower end of the end edge support part 233 and the left and right side edge support parts 32 that similarly have high rigidity. Hence, a load input from a seated person' back to the backrest 30 is supported by the leg part 10 with high rigidity.

Additionally, in the chair 1*a* related to the second embodiment, the curved part 35 that is curved toward the rear side is provided on the upper end side of the back plate part 31 of the backrest 30, and the vertically-long elongated hole-shaped openings 34 are formed at least in the range covering the curved part 35. Therefore, when a load is input from a seated person's back to the rear side on the upper end part side of the back plate part 31, a part that comes into contact with the seated person can be flexibly deformed without receiving a large restraining force in the vicinity of the curved part 35. That is, although an extending end side of the curved part 35 is formed a shape that is continuous without being separating in the width direction, the vertically-long openings 34 are present at least in the vicinity of the base end part of the curved part 35 that is continuous with a general surface of the front surface of the back plate part 31. Hence, limitation of deformation on the extending end of the curved part 35 can be suppressed to the minimum, and large bending deformation of a front upper part of the back plate part 31 can be allowed.

In more detail, in the case of the second embodiment, the elongated hole-shaped openings 34 are formed in the curved part 35 that is curved toward the rear side. Therefore, a load that acts on the general surface of the back plate part 31 from a seated person's back acts as a force to bend the front surface side of the entire curved part 35 to the rear side in a plan view rather than trying to widen the individual openings 34 in the width direction. Additionally, in this case, each opening 34 of the curved part 35 extends vertically long toward the rear side. Therefore, side edge parts of the plurality of openings 34 covering a wide range of the curved part 35 in the width direction are bendingly deformed gently by the length of the side edge part of each opening 34 without a portion of the curved part 35 being largely deformed. From these, when a load acts on the general surface of the back plate part 31 from a seated person's back, the limitation of deformation on the upper end side of the back plate part 31 can be made small, and more flexible deformation of the general surface of the back plate part 31 can be obtained.

Hence, in the backrest 30 of the chair 1*a* related to the second embodiment, high support rigidity on each side edge support part 32, and flexible deformation in the vicinity of the upper end part can be obtained, even though a structure consisting an integral molding component is provided.

Additionally, in the case of the backrest 30 of the chair 1*a* related to the second embodiment, the front surface side is formed by the smoothly continuous surface that does not substantially have a level difference. Therefore, the back plate part 31 can be bendingly deformed efficiently without giving a discomfort to a seated person who leans his/her back on the backrest 30.

Meanwhile, in the case of the backrest 30 related to the second embodiment, on the rear surface side, the rear surface of the back plate part 31 forms the level difference on the front side with respect to the rear surface of each side edge support part 32 or the end edge support part 233. Thus, a load when a seated person leans on the rear part is input to the end part on the front surface side of each of the left and right side edge support parts 32 as a load in a compression direction from the back plate part 31. Hence, the backrest 30 related to the second embodiment is different from a case where the rear surface of the back plate part 31 is continuously provided so as to be biased toward the rear surface side of each side edge support part 32 or the end edge support part 233, when a load to a seated person's back acts on the back plate part 31. Therefore, since s tension load does not easily concentrate on a connected portion between the back plate part 31 and each side edge support part 32, the back plate part 31 can be flexibly deformed in a wider range.

Moreover, in the backrest 30 related to the second embodiment, the thickness of the left and right side edge support parts 32 in the forward-backward direction is greater than the thickness of the back plate part 31 in the forward-backward direction. Hence, a load input from the back plate part 31 to each of the left and right side edge support parts 32 can be supported with higher rigidity by the side edge support part 32.

Additionally, in the backrest 30 related to the second embodiment, the end edge support part 233 that functions as a strengthening member is provided to extend to the lower side of the back plate part 31 in the width direction, and both end parts of the end edge support part 233 are coupled to the lower ends of the left and right side edge support parts 32. Hence, even in a case where the amount of bending deformation on the curved part side of the upper end is set to be large, rigidity on remaining three sides of a peripheral edge of the back plate part 31 can be sufficiently secured by the left and right side edge support parts 32 and the end edge support part 233 on the lower side.

Third Embodiment

Figure 15:
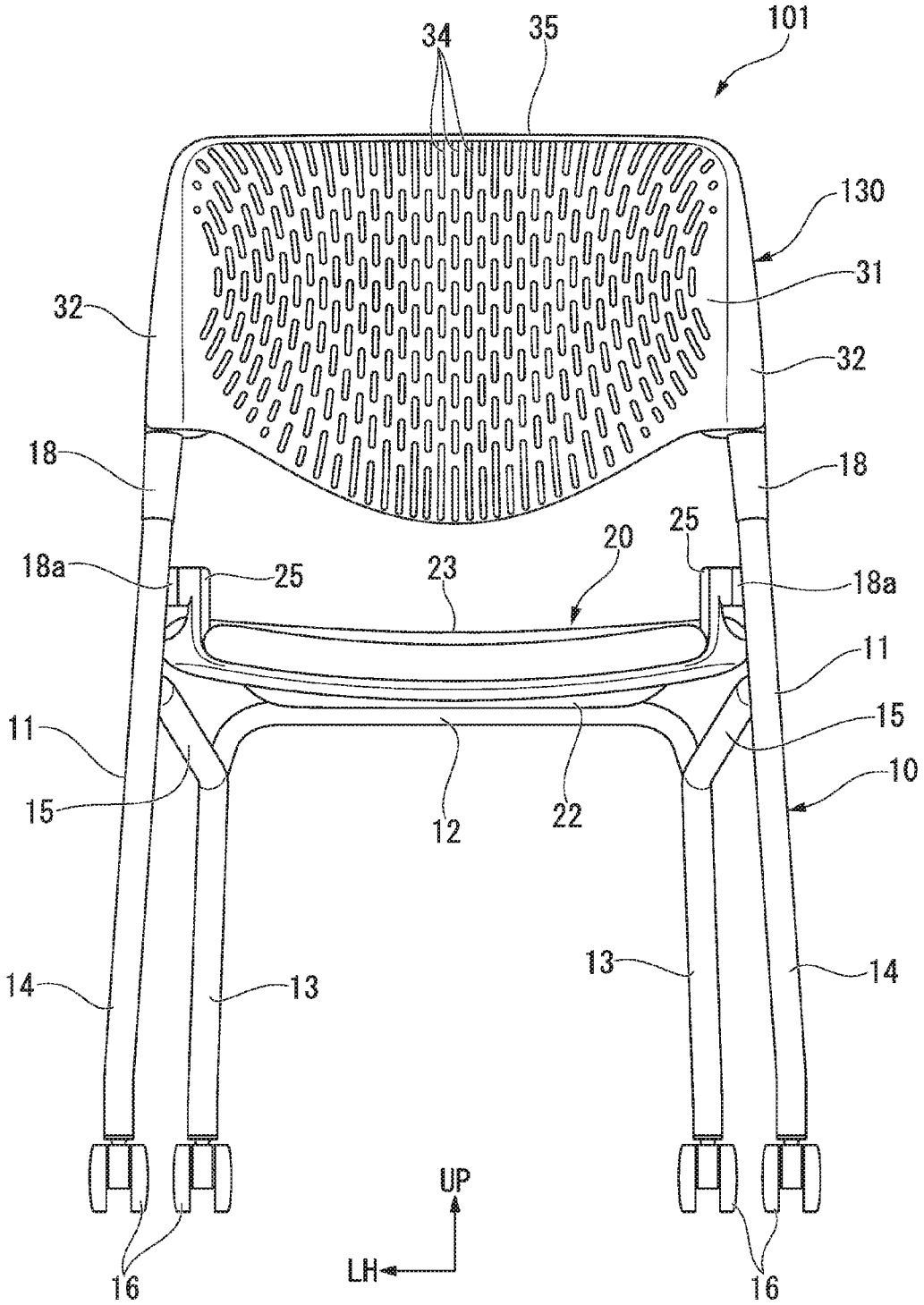
FIG. 15 is a back view of a chair related to a third embodiment of the invention.

FIG. 15 is a view showing a back surface of a chair 101 related to a third embodiment. In addition, in description of respective embodiments to be described below, the same parts as those of the above first and second embodiments will be designated by the same reference signs, and a duplicate description thereof will be omitted here.

The chair 101 related to the third embodiment is made to have the same basic configuration as that of the second embodiment except for a backrest 130. Although the backrest 130 includes the substantially rectangular plate-shaped back plate part 31 that receives a load to a seated person's back, and the pair of side edge support parts 32 that are formed integrally with left and right opposite sides of the back plate part 31 and function as strengthening members, the end edge support part (233) that are formed integrally with the lower side of the back plate part 31 and function as a strengthening member is not formed.

Hence, in the backrest 130 related to the third embodiment, bending deformation not only the upper end side but also on the bottom end side of the back plate part 31 can be increased.

In the third embodiment described here, the curved part that is curved to the back side is not provided on the bottom end side of the back plate part 31. However, a curved part may be provided on the bottom end side, similar to on the upper end side of the back plate part 31, and vertically-long openings may be formed in a range covering the curved part on the bottom end side. In this case, bending deformation on both upper and lower sides of the back plate part 31 is not easily limited, and it is possible to receive a load from a seated person's back to more flexibly deform the back plate part 31.

Fourth Embodiment

Subsequently, a fourth embodiment shown in FIGS. 16 and 17 will be described. In addition, in description of respective embodiments to be described below, the same parts as those of the above first to third embodiments will be designated by the same reference signs, and a duplicate description thereof will be omitted here.

Figure 16:
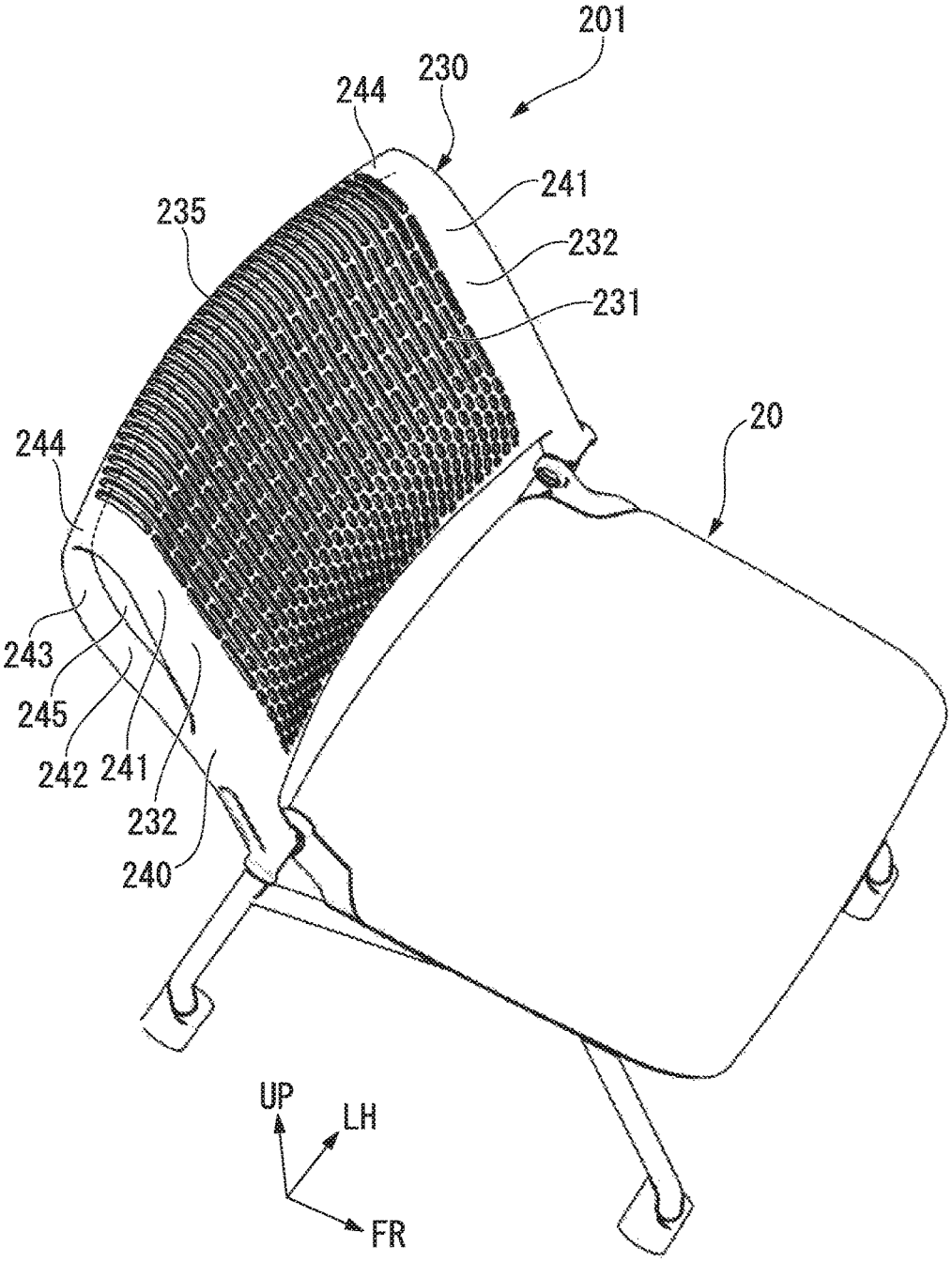
FIG. 16 is a perspective view of a chair related to a fourth embodiment of the invention.
Figure 17:
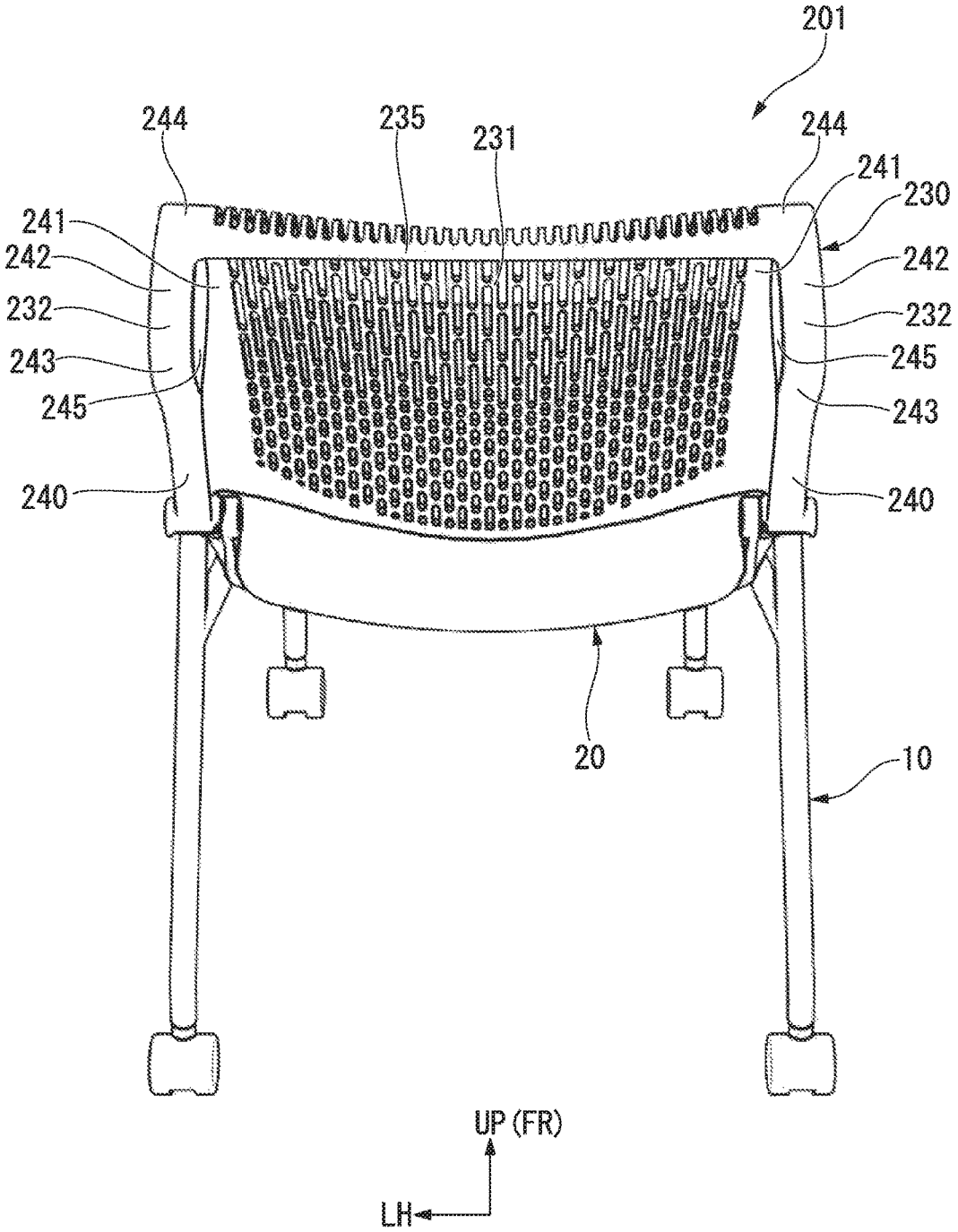
FIG. 17 is a perspective view of a chair related to a fourth embodiment of the invention.

FIG. 16 is a perspective view of a chair 201 related to a fourth embodiment of the invention as seen from an oblique upper right side, and 17 is a perspective view of the chair 201 related to the fourth embodiment of the invention from an upper part of a back surface.

The chair 201 related to the fourth embodiment is made to have the same basic configuration as that of the second embodiment except for a backrest 230. The backrest 230 is integrally formed of synthetic resin in its entirety, and includes a substantially rectangular back plate part 231, and a pair of side edge support parts 232 and 232 that are integrally formed at opposite left and right sides of the back plate part 231 and function as a strengthening member.

The back plate part 231 is formed to have a substantially constant thickness in its entirety, and the plurality of openings 34 for facilitating deformation of the back plate part 231 are formed in a substantially entire region of the back plate part. The openings 34 of the fourth embodiment are also formed in the shape of an elongated hole that is substantially in the upward-downward direction (an extending direction of the side edge support parts 232). The plurality of openings 34 extend in straight lines in the upward-downward direction and a plurality of rows of the openings that extends in the upward-downward direction are provided side by side in the width direction, and the openings 34 of rows adjacent to each other in the width direction are disposed so as to be offset in a houndstooth shape in the upward-downward direction.

Additionally, the central region of the back plate part 231 in the width direction is formed in a curved shape that becomes gently depressed to the rear side, and a curved part 235 that is curved toward the rear side (opposite back plate side) is provided to extend on the upper end side of the back plate part. However, the curved part 235 of the fourth embodiment is formed such that an extending end thereof faces the lower side beyond the substantially horizontal posture. That is, an end part of the curved part 235 in the extending direction is curved so as to have a change angle exceeding 90°. Although the aforementioned plurality of the elongated hole-shaped openings 34 are also formed over the curved part 235, an end part of each elongated hole-shaped opening 34 extends up to a positions in the vicinity of the extending end of the curved part 235, that is, a position where this end part is slightly curved to a lower rear side beyond a top part (extending end position) of the curved part 235. Hence, the elongated hole-shaped opening 34 extends so as to transverse the top part of the curved part 235 in the forward-backward direction.

Each of the side edge support parts 232 on both the left and right sides of the back plate part 231 is formed in a substantially prismatic shape from a lower end part thereof to a substantially central position in the upward-downward direction, and a substantially elliptical tubular part 243 (tubular structure) in which a plate-shaped front surface side supporting wall 241 that faces the front side (back plate side), and a plate-shaped back surface side supporting wall 242 that faces the rear side are coupled to each other at upper and lower ends is are provided continuously with an upper part of the prismatic part 240 of the side edge support part. A connecting part 244 on the upper end side that couples the front surface side supporting wall 241 and the back surface side supporting wall 242 together is formed in a circular-arc curved shape in a side view. Although the front surface side supporting wall 241 is formed in a substantially flat plate shape, the back surface side supporting wall 242 is formed in a curved shape that is slightly convexly curved to the rear side in a side view instead of the flat plate shape. A hollow part 245 is provided between the front surface side supporting wall 241 and the back surface side supporting wall 242, so that the back surface side supporting wall 242 can be gripped as a handle by a user such that fingers are inserted into the hollow part 245.

In addition, in the case of the fourth embodiment, the front surface side supporting wall 241 is formed with almost the same thickness as that of the back plate part 231.

Additionally, the back plate part 231 is formed to have a smaller thickness in the forward-backward direction than that of the left and right side edge support parts 232, and is connected such that both side parts thereof are continuously flush with the surfaces of the left and right side edge support parts 232. Particularly, both side parts of a substantially upper half part of the back plate part 231 are connected so as to be continuous with the front surface side supporting wall 241 of the tubular part 243 with almost the same thickness. Also, both side parts of the curved part 235 provided to extend at an upper part of the back plate part 231 is connected to the curved connecting part 244 of an upper part of the tubular part 243. Additionally, both the side parts of the curved part 235 are connects so as to be continuous with the connecting part 244 of the tubular part 243 with almost the same thickness.

Since the basic configuration of the backrest 230 of the chair 201 related to this fourth embodiment is the same as that of the second embodiment, almost the same effects as the second embodiment can be obtained. However, the following effects can be further obtained by the above unique configuration.

The backrest 230 related to the fourth embodiment is formed such that the extending end side of the curved part 235 of the back plate part 231 faces the lower side beyond the substantially horizontal posture, and the plurality of elongated hole-shaped openings 34 are formed in the forward-backward direction so as to straddle the top part of the curved part 235 of the backrest. Hence, bending deformation of the back plate part 231 when a load is input from a seated person's back is not easily limited even in a portion in the vicinity of the top part of the curved part 235. Hence, in the backrest 230 of the fourth embodiment, more flexible deformation of the back plate part 231 can be obtained, and also in a case where a load is directly input from a seated person to the vicinity of the top part of the curved part 235, the curved part 235 can be flexibly deformed.

Additionally, in the backrest 230 related to the fourth embodiment, the front surface side supporting wall 241 and the back surface side supporting wall 242 are annularly connected to an edge on an upper side of each side edge support part 232 at upper and lower ends thereof, and the tubular part 243 (tubular structure) is constituted. Hence, the high support rigidity of an upper edge part of the side edge support part 232, particularly, the high support rigidity in the forward-backward direction thereof can be obtained, without causing an increase in weight.

Moreover, in the case of the backrest 230 related to a fourth embodiment, the thickness of the front surface side supporting wall 241 is made to be almost the same thickness in the adjacent back plate part 231. Therefore, deformation in a part where the back plate part 231 is adjacent to the front surface side supporting wall 241 is not easily limited. Hence, in the case of the backrest 230 of the fourth embodiment, more flexible deformation of the back plate part 231 can be obtained.

Additionally, in the backrest 230 of the fourth embodiment, the tubular part 243 is provided at each side edge support part 232, and the hollow part 245 is formed on a front side of the back surface side supporting wall 242 of the tubular part 243. Therefore, there is an advantage that a user inserts his/her fingers into the hollow part 245 to easily grip the back surface side supporting wall 242 easily as a handle during movement of the chair 201.

Additionally, in the backrest 230 of the fourth embodiment, the connecting part 244 on the upper end side of each side edge support part 232 is formed in a curved shape, and the connecting part 244 is formed so as to be continuous with a side edge of the curved part 235 on the upper part side of the back plate part 231. Therefore, the connecting part 244 on the upper part side of the side edge support part 232 that functions as a strengthening member can be made to support the side edge of the curved part 235. Hence, in the case of the backrest 230 of the fourth embodiment, the deformation behavior of the curved part 235 when the curved part 235 receives a load from a seated person's back can be stabilized.

In addition, the invention is not limited to the above embodiments, and various design changes can be made without departing from the scope of the invention. For example, in the above respective embodiments, the backrest constitutes the load support of the chair. However, the load support may be not only the backrest but also the seat.

Figure 18:
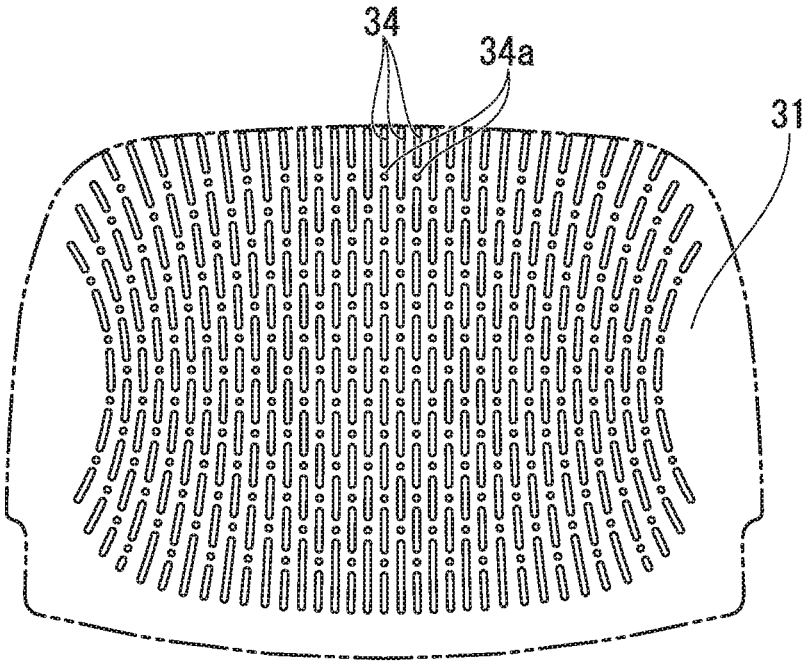
FIG. 18 is a front view of a back plate of a modification example of the invention.

Additionally, in all of the above respective embodiments, the openings formed in the back plate part of the backrest were altogether formed by the elongated hole-shaped openings that are long substantially in the upward-downward direction. For example, the elongated hole-shaped openings 34, and openings 34*a* that have a circular shape or the like, which is an elongated hole shape, are mixedly present and formed in the back plate part, as in a modification example shown in FIG. 18.

INDUSTRIAL APPLICABILITY

According to the invention, when a seated person's upper body leans at a substantially central position in the width direction of the backrest, the seated person's upper body can be held so as to be wrapped in due to flexible deformation of the back plate part and the rigidity of the reinforcing rib. Moreover, when the seated person's upper body is biased the left and right and leans, the side edge support part is flexibly deformed by the thin back plate extending part, so that discomfort, such as a sensation of pressure given to a seated person, can be eliminated.

Additionally, the curved part is provided at least on the one end side of the back plate part in the extending direction of each side edge support part, and the elongated hole-shaped openings substantially in the extending direction of the side edge support part are provided at least in the range covering the curved part. Therefore, even though a structure that does not cause an increase in the number of components is provided, the high support rigidity resulting from the side edge support part and the flexible deformation in the vicinity of the curved part can be obtained.

REFERENCE SIGNS LIST

1, 1*a*, 101, 201: CHAIR
30, 130, 230: BACKREST
31, 231: BACK PLATE PART
32, 232: SIDE EDGE SUPPORT PART
33: FITTING HOLE
233: END EDGE SUPPORT PART
34: OPENING
35, 235: CURVED PART
40: BACKREST POST
51: BACK PLATE EXTENDING PART
52: REINFORCING RIB
241: FRONT SURFACE SIDE SUPPORTING WALL
242: BACK SURFACE SIDE SUPPORTING WALL
244: CONNECTING PART

The invention claimed is:

1. A backrest for a chair comprising:

a substantially rectangular back plate part having side end parts in a width direction of the backrest, the width direction of the backrest being perpendicular to a forward-backward direction and an upward-downward direction; and a pair of side edge support parts that are formed integrally with the side end parts of the back plate part and have a maximum forward-backward thickness greater than that of the back plate part, the side edge support part including an upper region and a lower region, wherein the entire of the backrest is integrally formed of synthetic resin, wherein a fitting hole into which a backrest post is fitted from below is formed in the lower region of each of the pair of side edge support parts, wherein a thin back plate extending part and a reinforcing rib are provided in the upper region of each of the pair of side edge support parts, the back plate extending part extending from the side end part of the back plate part, the back plate extending part having a thinned section formed in an outside portion, in the width direction of the backrest, of a rear portion of the back plate extending part, a front surface of the back plate extending part being continuous with a front surface of the back plate part, the reinforcing rib protruding from an inside end part of the back plate extending part toward a rear side of the backrest, the inside end part being an end part, in the width direction of the backrest, of the back plate extending part positioned closer to a center of the backrest in the width direction of the backrest, and wherein the reinforcing rib extends substantially in the upward-downward direction, gradually increases in cross-sectional area toward a lower end side, and is connected to the lower region of the side edge support part.

2. The backrest for a chair according to claim 1, wherein the front surface of the back plate extending part is curved to the rear side toward an outer side in the width direction of the backrest.

3. The backrest for a chair according to claim 1, wherein an extending length of the back plate extending part from the reinforcing rib gradually decreases toward an upper end side.

4. The backrest for a chair according to claim 3, wherein upper edge parts of the back plate part and the side edge support part include curved parts that are curved or bend toward the rear side.

5. The backrest for a chair according to claim 4, wherein a plurality of openings for facilitating deformation of the back plate part are formed in the back plate part, wherein the openings of the back plate part formed in the vicinity of the curved part are elongated hole-shaped openings substantially in an extending direction of the side edge support part, and wherein the elongated hole-shaped openings are formed at least in a range covering the curved part.

6. The backrest for a chair according to claim 5, wherein surfaces of the back plate part and the side edge support part on the back plate side are formed by a continuous surface, and wherein a surface of the back plate part on an opposite back plate side forms a level difference on the back plate side with respect to the surface of the side edge support part on the opposite back plate side.

7. The backrest for a chair according to claim 6, wherein a thickness of the side edge support part in a back plate direction is made to be greater than a thickness of the back plate part in the back plate direction.

8. The backrest for a chair according to claim 5, wherein an end edge support part that functions as a strengthening member is provided on the other end side of the back plate part in the extending direction of the side edge support part, and both end parts of the end edge support part in an extending direction thereof are integrally coupled to a pair of the side edge support parts, and wherein the curved part is formed on one end side of the back plate part in the extending direction of the side edge support part.

9. The backrest for a chair according to claim 5, wherein the curved part is curved such that an end part in an extending direction forms a change angle exceeding 90°, and wherein the elongated hole-shaped openings are formed so as to straddle an endmost position of the curved part in the extending direction of the side edge support part.

10. The backrest for a chair according to claim 9, wherein a tubular structure in which a plate-shaped front surface side supporting wall that faces the back plate side, and a plate-shaped back surface side supporting wall that faces the opposite back plate side are annularly connected together in the extending direction of the side edge support part is provided at an end edge of the side edge support part where at least the curved part is located, and wherein the front surface side supporting wall is formed with almost the same thickness as the back plate part.

11. The backrest for a chair according to claim 10, wherein a connecting part on one end side of the front surface side supporting wall and the back surface side supporting wall is formed in a curved shape, and the connecting part is provided to be connected so as to be continuous with a side edge of the curved part.

12. A chair comprising:

the backrest for a chair according to claim 1; and the backrest posts.

13. The chair wherein the backrest for a chair according to claim 5 is supported by a supporting structure having a leg part.

14. The chair according to claim 13, wherein the backrest is supported by the supporting structure such that the curved part is curved to the rear side on the upper end side.

* * * * *